US010915045B2

(12) United States Patent
Nomura et al.

(10) Patent No.: US 10,915,045 B2
(45) Date of Patent: Feb. 9, 2021

(54) FIXING APPARATUS AND IMAGE FORMING APPARATUS THAT SET TARGET TEMPERATURES OF HEAT GENERATING ELEMENTS FOR HEATING A DEVELOPER IMAGE IN EACH OF A PLURALITY OF REGIONS

(71) Applicant: CANON KABUSHIKI KAISHA, Tokyo (JP)

(72) Inventors: Takashi Nomura, Susono (JP); Takahiro Uchiyama, Mishima (JP); Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/695,667

(22) Filed: Nov. 26, 2019

(65) Prior Publication Data

US 2020/0096921 A1 Mar. 26, 2020

Related U.S. Application Data

(63) Continuation of application No. 16/370,004, filed on Mar. 29, 2019, now Pat. No. 10,520,866, which is a (Continued)

(30) Foreign Application Priority Data

Feb. 2, 2017 (JP) ..... 2017-017537

(51) Int. Cl.
*G03G 15/20* (2006.01)

(52) U.S. Cl.
CPC ..... *G03G 15/2039* (2013.01); *G03G 15/2042* (2013.01); *G03G 15/2046* (2013.01); *G03G 15/2053* (2013.01); *G03G 2215/2035* (2013.01)

(58) Field of Classification Search
CPC ..... G03G 15/201; G03G 15/2007; G03G 15/2039; G03G 15/2053
(Continued)

(56) References Cited

U.S. PATENT DOCUMENTS 4,434,353 A 2/1984 Marsh et al.
5,151,719 A 9/1992 Akutsu et al.
(Continued)

FOREIGN PATENT DOCUMENTS

JP 2007-271870 A 10/2007
JP 2013-041118 A 2/2013
(Continued)

*Primary Examiner* — William J Royer
(74) *Attorney, Agent, or Firm* — Venable LLP

(57) ABSTRACT

A fixing apparatus includes a plurality of heat generating elements for heating a developer image formed on a recording medium corresponding to a plurality of heating regions. A first target temperature of the heat generating elements is set based on a developer amount per unit area of the developer image in each of the heating regions, and the temperature of the heat generating elements is controlled to the first target temperature. If a difference between the first target temperatures for two adjacent heating regions is outside of a predetermined range, the first target temperature for one of the two adjacent heating regions is corrected to a second target temperature, which is greater than the first target temperature, so that the difference between the first target temperatures for the two adjacent heating regions is within the predetermined range.

4 Claims, 18 Drawing Sheets

Related U.S. Application Data continuation of application No. 15/878,684, filed on Jan. 24, 2018, now Pat. No. 10,254,689.

(58) Field of Classification Search
USPC ..... 399/69, 328, 334, 336; 219/216
See application file for complete search history.

(56) References Cited

U.S. PATENT DOCUMENTS

| | | | |
|---|---|---|---|
| 5,402,211 | A | 3/1995 | Yoshikawa |
| 5,402,220 | A | 3/1995 | Tanaka et al. |
| 7,193,181 | B2 | 3/2007 | Makihira et al. |
| 7,283,145 | B2 | 10/2007 | Kato et al. |
| 7,366,455 | B2 | 4/2008 | Iwasaki et al. |
| 7,440,722 | B2 | 10/2008 | Lofthus et al. |
| 7,599,637 | B2 | 10/2009 | Nanataki et al. |
| 7,865,102 | B2 | 1/2011 | Nanataki et al. |
| 9,091,974 | B2 | 7/2015 | Yoshioka et al. |
| 9,235,166 | B2 | 1/2016 | Shimura |
| 9,335,709 | B2 | 5/2016 | Iwasaki et al. |
| 9,377,727 | B2 | 6/2016 | Yoshioka et al. |
| 9,568,867 | B2 | 2/2017 | Yoshioka et al. |
| 9,665,048 | B2 | 5/2017 | Iwasaki et al. |
| 9,989,900 | B2 | 6/2018 | Yoshioka et al. |
| 10,054,882 | B2 | 8/2018 | Nomura et al. |
| 10,114,318 | B2 | 10/2018 | Sako et al. |
| 10,185,258 | B2 | 1/2019 | Sako et al. |
| 10,254,689 | B2 | 4/2019 | Nomura et al. |
| 10,520,866 | B2 * | 12/2019 | Nomura et al. ... G03G 15/2039 |
| 2015/0346660 | A1 | 12/2015 | Usui et al. |
| 2016/0070216 | A1 | 3/2016 | Shimura |
| 2017/0102653 | A1 | 4/2017 | Yoshioka et al. |
| 2018/0004134 | A1 | 1/2018 | Nomura et al. |
| 2018/0004135 | A1 | 1/2018 | Sako et al. |
| 2018/0004136 | A1 | 1/2018 | Iwasaki |
| 2018/0032008 | A1 | 2/2018 | Sako et al. |

FOREIGN PATENT DOCUMENTS

| | | | |
|---|---|---|---|
| JP | 2014-059508 | A | 4/2014 |
| JP | 2015-059992 | A | 3/2015 |

* cited by examiner

FIG.7

| $D_{MAX}(i)$ (%) | $FT_i$ (℃) |
|---|---|
| $200 \leqq D_{MAX} \leqq 230$ | 205 |
| $170 \leqq D_{MAX} < 200$ | 202 |
| $140 \leqq D_{MAX} < 170$ | 199 |
| $100 \leqq D_{MAX} < 140$ | 196 |
| $0 < D_{MAX} < 100$ | 193 |

FIG.9

| | | $A_1$ | $A_2$ | $A_3$ | $A_4$ | $A_5$ | $A_6$ | $A_7$ |
|---|---|---|---|---|---|---|---|---|
| IMAGE HEATING PORTION | $D_{MAX}$(%) | 120 | 70 | 50 | 90 | 210 | 90 | 0 |
| | FT(°C) | 196 | 193 | 193 | 193 | 205 | 193 | — |
| NON-IMAGE-HEATING PORTION | PT(°C) | 120 | 120 | 120 | 120 | 120 | 120 | 120 |

Prior Art

FIG.12

| | | $PR_1$ | $PR_2$ | $PR_3$ | $PR_4$ | $PR_5$ | $PR_6$ | $PR_7$ |
|---|---|---|---|---|---|---|---|---|
| $D_{MAX}$(%) | | 120 | 70 | 50 | 90 | 210 | 90 | - |
| TGT(PRi) (°C) | CONVENTIONAL EXAMPLE 1-1 | 196 | 193 | 193 | 193 | 205 | 193 | 120 |
| | CONVENTIONAL EXAMPLE 1-2 | 205 | 205 | 205 | 205 | 205 | 205 | 120 |
| | EXAMPLE 1 | 196 | 193 | 195 | 200 | 205 | 200 | 120 |

FIG.13A

| TGT(°C) | TC |
|---|---|
| 200＜TGT≦205 | 1.1 |
| 195＜TGT≦200 | 1.0 |
| 190＜TGT≦195 | 0.9 |
| 120＜TGT≦190 | 0.7 |
| TGT＝120 | 0.4 |

FIG.13B

| HL(mm) | LC |
|---|---|
| HL≦50 | 1 |
| 50＜HL≦100 | 2 |
| 100＜HL≦150 | 3 |
| 150＜HL≦200 | 4 |
| 200＜HL≦250 | 5 |
| 250＜HL≦300 | 6 |
| 300＜HL≦400 | 7 |
| 400＜HL | 8 |

FIG.13C

| STARTUP COUNT | WUC＝2.0 |
|---|---|
| INTER-PAPER COUNT | INC＝0.5 |
| POST-ROTATION COUNT | PC＝1.0 |
| RECORDING MATERIAL PASSAGE COUNT | RMC＝0.4 |
| HEAT DISSIPATION COUNT | DC＝0.1 |

FIG.14

| CT | CORRECTION VALUE |
|---|---|
| 20≦CT<50 | −1 |
| 50≦CT<100 | −2 |
| 100≦CT<150 | −4 |
| 150≦CT<200 | −6 |
| 200≦CT | −8 |

FIG.17A

| | | $A_1$ | $A_2$ | $A_3$ | $A_4$ | $A_5$ | $A_6$ | $A_7$ |
|---|---|---|---|---|---|---|---|---|
| TGT(°C) | IMAGE-1 PORTION | 120 | 120 | 120 | 205 | 205 | 200 | 120 |
| | LB PORTION | 120 | 120 | 120 | 205 | 205 | 120 | 120 |
| | IMAGE-2 PORTION | 120 | 195 | 200 | 205 | 205 | 120 | 120 |

FIG.17B

| | | $A_1$ | $A_2$ | $A_3$ | $A_4$ | $A_5$ | $A_6$ | $A_7$ |
|---|---|---|---|---|---|---|---|---|
| TGT(°C) | IMAGE-1 PORTION | 120 | 120 | 120 | 193 | 193 | 193 | 120 |
| | LB PORTION | 120 | 120 | 120 | 120 | 120 | 120 | 120 |
| | IMAGE-2 PORTION | 120 | 195 | 200 | 205 | 205 | 120 | 120 |

FIXING APPARATUS AND IMAGE FORMING APPARATUS THAT SET TARGET TEMPERATURES OF HEAT GENERATING ELEMENTS FOR HEATING A DEVELOPER IMAGE IN EACH OF A PLURALITY OF REGIONS

This application is a continuation application of U.S. patent application Ser. No. 16/370,004, filed Mar. 29, 2019, which is a continuation application of U.S. patent application Ser. No. 15/878,684, filed Jan. 24, 2018, now issued as U.S. Pat. No. 10,254,689 dated Apr. 9, 2019, which claims the benefit of Japanese Patent Application No. 2017-017537, filed on Feb. 2, 2017, all of which are hereby incorporated by reference herein in their entireties.

BACKGROUND OF THE INVENTION

Field of the Invention

The present invention relates to a fixing apparatus for fixing, on a recording medium, a developer image formed on the recording medium, and to an image forming apparatus that forms an image on a recording medium by using a developer.

Description of the Related Art

In an image forming apparatus using an electrophotographic technique, when an image is formed on a recording material, a photosensitive drum is initially uniformly charged by a charging roller. Next, the charged photosensitive drum is selectively exposed by an exposure device, whereby an electrostatic latent image is formed on the photosensitive drum. The electrostatic latent image formed on the photosensitive drum is then developed as a toner image with a developing device using a toner. The toner image formed on the photosensitive drum is thereafter transferred to a recording material, such as a recording paper or a plastic sheet, and the toner image transferred to the recording material is heated and pressed with a fixing apparatus, thereby fixing the toner image on the recording material. In this way, an image is formed on the recording material. Further, the toner remaining on the photosensitive drum after the toner image has been transferred to the recording material is removed by a cleaning blade.

Conventionally, a fixing apparatus is known that includes an endless fixing film, a heater contacting the inner surface of the fixing film, and a pressure roller forming a nip portion with the heater, with the fixing film interposed therebetween. Since the heat capacity of the heater and the fixing film is small, this fixing apparatus excels in a quick start property (the shortening of the time required for the temperature of the heater and the fixing film to rise) and a power saving property (low electrical power consumed for raising the temperature of the heater and the fixing film). In recent years, however, a demand for further power saving in a fixing apparatus has grown.

With the technique disclosed in Japanese Patent Application Laid-open No. 2015-059992, electrical power consumed by the fixing apparatus is saved by selectively heating the recording material on which the toner image has been formed. More specifically, with the technique disclosed in Japanese Patent Application Laid-open No. 2015-059992, the recording material is divided into a plurality of heating regions in a direction orthogonal to the conveying direction of the recording material. A plurality of heat generating elements are arranged side by side in a direction orthogonal to the conveying direction of the recording material correspondingly to the plurality of heating regions so as to heat the plurality of heating regions. The plurality of heating regions are respectively heated by the plurality of heat generating elements. An image formation portion, on which an image is formed in a heating region, is selectively heated by the heat generating element on the basis of image information on the image formed in each heating region.

In the technique disclosed in Japanese Patent Application Laid-open No. 2007-271870, an image formation portion on which an image is formed on a recording material is divided into a plurality of heating regions in a direction orthogonal to the conveying direction of a recording material. Temperatures at which a plurality of heat generating elements heat a plurality of heating regions are set according to the type of the image formed in the heating region. Consequently, the electrical power consumed by the fixing apparatus is reduced.

With the techniques disclosed in Japanese Patent Application Laid-open No. 2015-059992 and Japanese Patent Application Laid-open No. 2007-271870, as described above, the recording material is divided into a plurality of heating regions in a direction orthogonal to the conveying direction of the recording material, and the plurality of heat generating elements respectively heat the plurality of heating regions, thereby saving the electrical power consumed by the fixing apparatus. The following problems are, however, associated with the techniques disclosed in Japanese Patent Application Laid-open No. 2015-059992 and Japanese Patent Application Laid-open No. 2007-271870.

Here, a technique is considered by which, when a plurality of image formation portions (portions in which images are formed) are present in one heating region, the heating region is heated at a temperature corresponding to the image formation portion having the highest image density among the plurality of image formation portions. For example, when two image formation portions are present in one heating region, the two image formation portions are heated at a temperature for heating the portion in which an image with a dark color (an image with a large amount of toner (amount of developer) for forming an image), among the two image formation portions, is formed.

FIG. 18 is an enlarged view of two heating regions X and Y divided in a direction orthogonal to the conveying direction of a recording material. The heating regions X and Y are adjacent to each other, an image PIC1 is formed in the heating region X, and an image PIC2 is formed across the heating region X and the heating region Y. Further, the image density of the image PIC1 is taken as an image density DX, and the image density of the image PIC2 is taken as an image density DY (DX>DY). In the heating region X, an image formation portion PRX (within the broken line), which is the portion in which an image is formed, is heated. Similarly, in the heating region Y, an image formation portion PRY (within the broken line), which is the portion in which an image is formed, is heated. Since the image PIC1 has the highest image density in the image formation portion PRX, according to this technique, the image formation portion PRX is heated at a heating temperature TX corresponding to the image density DX. Meanwhile, since the image PIC2 has the highest image density in the image formation portion PRY, according to this technique, the image formation portion PRY is heated at a heating temperature TY corresponding to the image density DY. Here, in FIG. 18, the heating temperature TX is greater than the heating temperature TY (for example, TX=TY+8° C.). Further, as shown in FIG. 18, the image PIC2 is formed from an image PIC2Y in the heating region Y and an image PIC2X in the heating region X.

Here, with this technique, since the image PIC2X and the image PIC2Y in the image PIC2 are heated at different temperatures, the gloss may differ between the image PIC2X and the image PIC2Y. That is, a marked difference in gloss is generated between PIC2X and PIC2Y in the image PIC2, which should originally have a uniform gloss, and a difference in gloss may occur at the boundary portion between the heating regions X and Y.

Further, a similar problem may occur even when similar images are formed in two respective heating regions and the images are not continuous so as to straddle the two heating regions. Specifically, when similar images are formed in two heating regions, since the two heating regions are heated at different temperatures, the gloss or density of the two images, which should originally be similar, may differ greatly from each other.

SUMMARY OF THE INVENTION

It is, therefore, an object of the present invention to reduce electrical power consumed by the fixing apparatus and to improve the quality of the image formed on the recording medium in the fixing apparatus or the image forming apparatus, in which a toner image is fixed on a recording material, by heating each of a plurality of heating regions.

In order to attain the above-described object, the present invention provides a fixing apparatus including a plurality of heat generating elements for heating a developer image formed on a recording medium in each heating region, the heat generating elements fixing the developer image formed on the recording medium to the recording medium by heating, wherein a first target temperature of the heat generating elements for heating the developer image is set based on a developer amount per unit area of the developer image in each of the heating regions, and the temperature of the heat generating elements is controlled to the first target temperature, and wherein, in a case in which a developer image, in which the amount of developer per unit area is substantially the same, is formed over two adjacent heating regions and a difference between the first target temperatures for two adjacent heating regions is outside a predetermined range, the first target temperature for one of the two adjacent heating regions is corrected to a second target temperature, which is greater than the first target temperature, so that the difference between the first target temperatures for the two adjacent heating regions is within the predetermined range.

Further, in order to attain the above-described object, the present invention provides an image forming apparatus including an image formation portion for forming a developer image on a recording medium, the fixing apparatus as described above, and a control portion for controlling temperature of the heat generating elements.

The present invention makes it possible to reduce the electrical power consumed by the fixing apparatus and to improve the quality of the image formed on the recording material in the fixing apparatus or the image forming apparatus, in which a toner image is fixed on a recording material, by heating a plurality of heating regions.

Further features of the present invention will become apparent from the following description of exemplary embodiments with reference to the attached drawings.

BRIEF DESCRIPTION OF THE DRAWINGS

FIG. 7 shows a relationship between a toner amount conversion maximum value and a scheduled heating temperature according to the present Example.

FIG. 9 shows a toner amount conversion maximum value, a scheduled heating temperature, and a scheduled heating temperature.

FIG. 12 is a diagram in which the control temperatures according to Conventional Example 1-1, Conventional Example 1-2, and Example 1 are compared.

FIGS. 13A to 13C are diagrams used to obtain a count value of a heat accumulation counter in Example 2.

FIG. 14 is a diagram showing a relationship between a heat accumulation count value and a control temperature correction value.

FIGS. 17A and 17B are diagrams showing values of control temperature in the heating region when printing an image.

DESCRIPTION OF THE EMBODIMENTS

Hereafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Example 1

Figure 2:
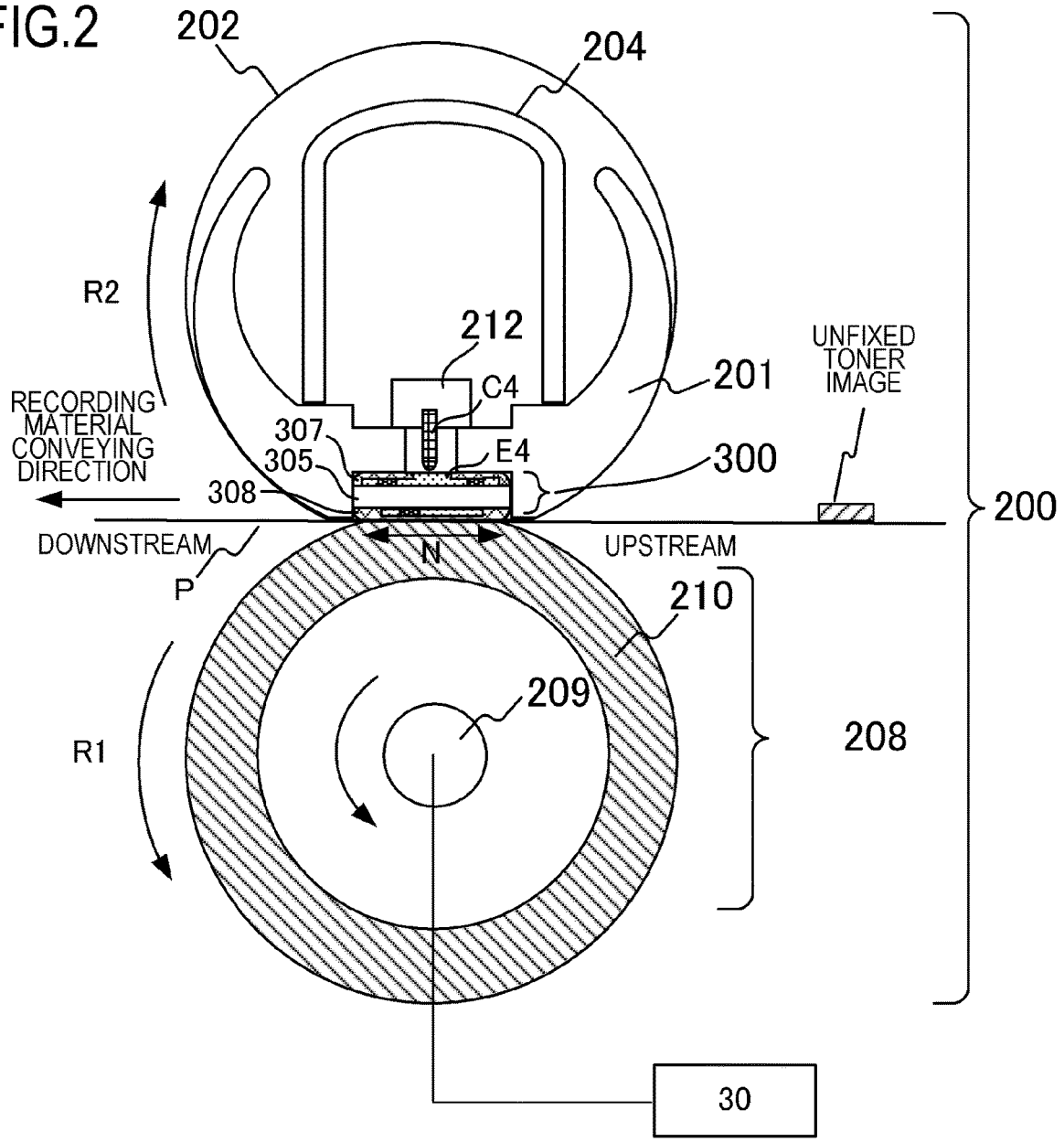
FIG. 2 is a schematic view of an image heating apparatus according to Example 1.

A heater 300 (corresponding to a heating member) (as shown in FIG. 2) and an image heating apparatus 200 (corresponding to a fixing apparatus) according to the present Example will be described below with reference to the drawings.

1. Configuration of Image Forming Apparatus 100

Figure 1:
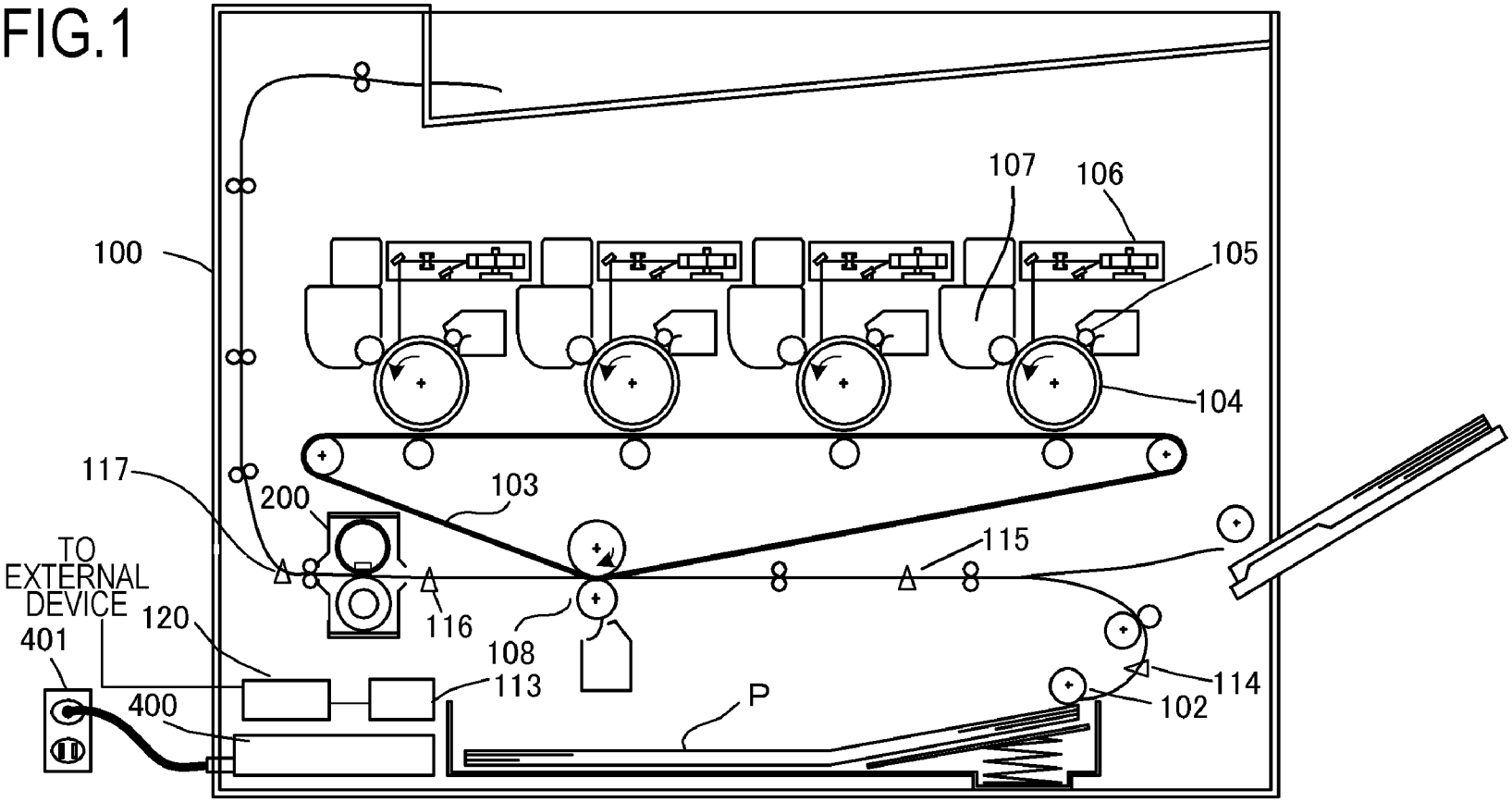
FIG. 1 is a schematic diagram of an image forming apparatus according to Example 1.

FIG. 1 is a schematic diagram of an image forming apparatus 100 according to Example 1. A video controller 120 receives and processes image information and a print instruction transmitted from an external device, such as a personal computer. A control portion 113 is connected to the video controller 120 and controls each portion constituting the image forming apparatus 100 according to the instruction from the video controller 120.

When the video controller 120 receives a print instruction from the external device, image formation is executed by the following operations. In the image forming apparatus 100, a sheet-shaped recording material P (corresponding to a recording medium) is fed by a feeding roller 102 and is conveyed toward an intermediate transfer body 103. A photosensitive drum 104 is rotationally driven in a counter-clockwise direction (see FIG. 1) at a predetermined speed by the power of a driving motor (not shown), and uniformly charged by a primary charger 105 during the rotation.

Laser light modulated correspondingly to the image signal is outputted from a laser beam scanner 106, and the surface of the photosensitive drum 104 is selectively scanned and exposed by the laser light, whereby an electrostatic latent image is formed on the photosensitive drum 104. A developing device 107 visualizes the electrostatic latent image on the photosensitive drum 104 as a toner image (corresponding to a developer image) by attaching a powder toner to the electrostatic latent image on the photosensitive drum 104. The toner image formed on the photosensitive drum 104 is primarily transferred onto the intermediate transfer body 103 rotating while contacting the photosensitive drum 104.

Here, the photosensitive drum 104, the primary charger 105, the laser beam scanner 106, and the developing device 107 are arranged correspondingly to four colors of cyan (C), magenta (M), yellow (Y), and black (K). Toner images for four colors are sequentially overlapped and transferred onto the intermediate transfer body 103 by the same procedure. The toner image transferred onto the intermediate transfer body 103 is secondarily transferred onto the recording material P (corresponding to "onto the recording medium") by a transfer bias applied to a transfer roller 108 in a secondary transfer portion formed by the intermediate transfer body 103 and the transfer roller 108.

Thereafter, the image heating apparatus 200 heats and pressurizes the recording material P, whereby the toner image is fixed to the recording material P, and the recording material P is discharged as an image formation object to the outside of the image forming apparatus 100. The control portion 113 manages the conveyance state of the recording material P from the information detected by a conveyance sensor 114, a registration sensor 115, a pre-fixing sensor 116, and a fixing discharge sensor 117 on the conveyance path of the recording material P. In addition, the control portion 113 has a storage portion that stores a temperature control program and a temperature control table of the image heating apparatus 200. A control circuit 400 as heater driving means connected to a commercial alternative current (AC) power supply 401 supplies power to the image heating apparatus 200.

2. Configuration of Image Heating Apparatus 200

FIG. 2 is a schematic diagram of the image heating apparatus 200 according to Example 1. The image heating apparatus 200 has a fixing film 202 as an endless belt and the heater 300 in contact with the inner surface of the fixing film 202. The image heating apparatus 200 also has a pressure roller 208 (corresponding to a pressing member) that forms a fixing nip portion N together with the heater 300, with the fixing film 202 being interposed therebetween, and a metal stay 204.

The fixing film 202 is a multilayer heat-resistant film formed in a tubular shape. Further, a heat-resistant resin, such as a polyimide, having a thickness of about 50 μm to 100 μm, or a metal, such as stainless steel, having a thickness of about 20 μm to 50 μm, is used as the base layer. On the surface of the fixing film 202, a heat-resistant resin having excellent releasability, such as a perfluoroalkoxy alkane (PFA) with a thickness of about 10 μm to 50 μm, is used as a release layer in order to prevent adhesion of the toner and to ensure separability from the recording material P. Here, the PFA is a tetrafluoroethylene-perfluoroalkyl vinyl ether copolymer.

Furthermore, in the image forming apparatus 100 that forms a color image, it is necessary to improve image quality. For this purpose, a heat-resistant rubber, such as a silicone rubber, having a thickness of about 100 μm to 400 μm and a thermal conductivity of about 0.2 W/m·K to 3.0 W/m·K, may be provided as an elastic layer between the above-described base layer and release layer of the fixing film 202. In this Example, from the viewpoints of thermal responsiveness, image quality, durability, and the like, a polyimide having a thickness of 60 μm is used as the base layer, a silicone rubber having a thickness of 300 μm and a thermal conductivity of 1.6 W/m·K is used as the elastic layer, and the PFA having a thickness of 30 μm is used as the release layer.

The pressure roller 208 has a metal core 209 made of iron, aluminum, or the like, and an elastic layer 210 made of a silicone rubber, or the like. Further, the heater 300 is held by a heater holding member 201 made of a heat-resistant resin, and heats the fixing film 202. The heater holding member 201 also has a guide function for guiding the rotation of the fixing film 202. The metal stay 204 receives a pressing force (not shown) and urges the heater holding member 201 toward the pressure roller 208. The pressure roller 208 receives the power from a motor 30 and rotates in the direction of an arrow R1. As the pressure roller 208 rotates, the fixing film 202 follows and rotates in the direction of an arrow R2. In the fixing nip portion N, the recording material P is nipped and conveyed, and heat is applied to the fixing film 202, whereby the unfixed toner image on the recording material P is fixed to the recording material P.

The heater 300 is heated by a heat generating resistor provided on a ceramic substrate 305. The heater 300 is provided with a surface protective layer 308 provided on a side close to the fixing nip portion N, and a surface protective layer 307 provided on a side far from the fixing nip portion N. There are provided a plurality of electrodes (here, represented by an electrode E4) provided on the side far from the fixing nip portion N and a plurality of electrical contacts (here, represented by an electrical contact C4), and electrical power is supplied to the electrodes from the electrical contacts. The heater 300 will be explained in detail with reference to FIGS. 3A to 3C. A safety element 212, such as a thermo-switch or a thermal fuse, which is actuated by abnormal heat generation in the heater 300 to shut off power supplied to the heater 300, is connected to the heater 300 directly or indirectly through the heater holding member 201.

3. Configuration of Heater 300

Figure 3A:
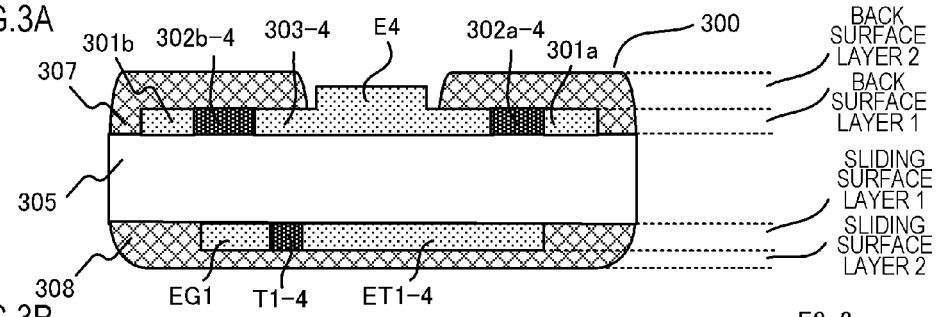
FIGS. 3A to 3C are exploded views of a heater according to Example 1.
Figure 3B:
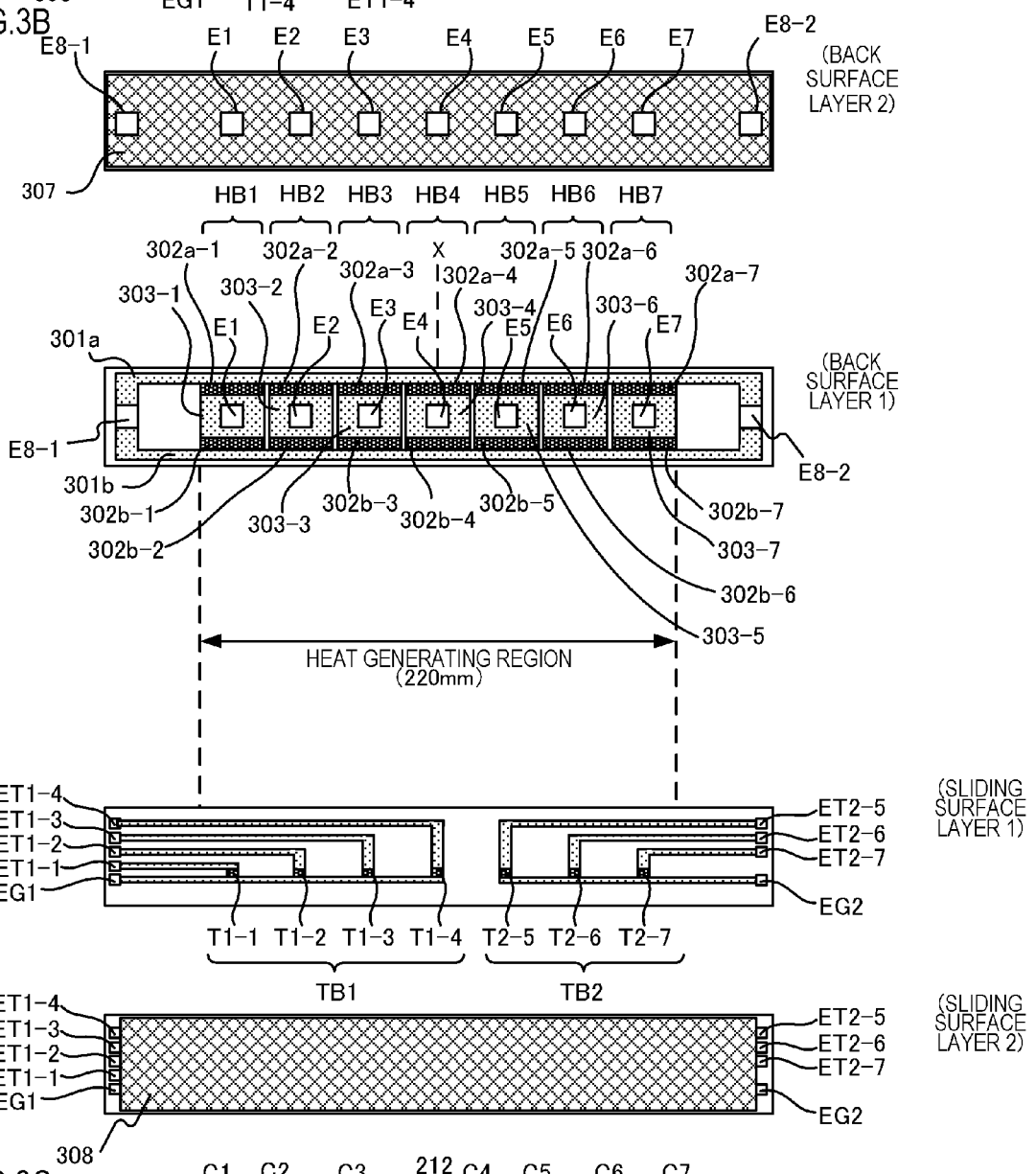
Figure 3C:
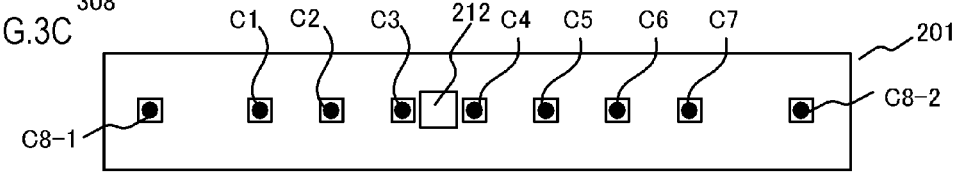

FIGS. 3A to 3C are exploded views of the heater 300 according to Example 1. More specifically, FIG. 3A is a cross-sectional view of the heater 300 in the vicinity of a conveyance reference position X shown in FIG. 3B. Here, the conveyance reference position X is defined as a reference position when the recording material P is conveyed. Further, in the present Example, the recording material P is conveyed so that the central portion of the recording material P passes through the conveyance reference position X.

The heater 300 has a first electrical conductor 301 (301*a*, 301*b*) provided along the longitudinal direction of the heater 300 on the back surface side of the substrate 305. Further, the heater 300 has a second electrical conductor 303 (303-4) provided along the longitudinal direction of the heater 300 at positions different from those of the first electrical conductor 301 and the heater 300 in the lateral direction of the first electrical conductor 301 and the heater 300 on the back surface side of the substrate 305. In FIGS. 3A to 3C, the second electrical conductor 303 becomes the second electrical conductor 303-4 in the vicinity of the conveyance reference position X.

The first electrical conductor 301 is separated into an electrical conductor 301*a* arranged on the upstream side in the conveying direction of the recording material P and an electrical conductor 301*b* arranged on the downstream side. Furthermore, the heater 300 has a heat generating resistor 302 that is provided between the first electrical conductor 301 and the second electrical conductor 303 and generates heat under the effect of electrical power supplied via the first electrical conductor 301 and the second electrical conductor 303. In the present Example, the heat generating resistor 302 is divided into a heat generating resistor 302*a* (302*a*-4 in the vicinity of the conveyance reference position X) disposed on the upstream side in the conveying direction of the recording material P and a heat generating resistor 302*b* (302*b*-4 in the vicinity of the conveyance reference position X) disposed on the downstream side. Further, on the back surface layer 2 of the heater 300, the electrically insulating surface protective layer 307 is provided outside of the electrode portion (E4 in the vicinity of the conveyance reference position X) so as to cover the heat generating resistor 302, the first electrical conductor 301, and the second electrical conductor 303 (303-4 in the vicinity of the conveyance reference position X). In this Example, the surface protective layer 307 is made of glass.

Figure 5:
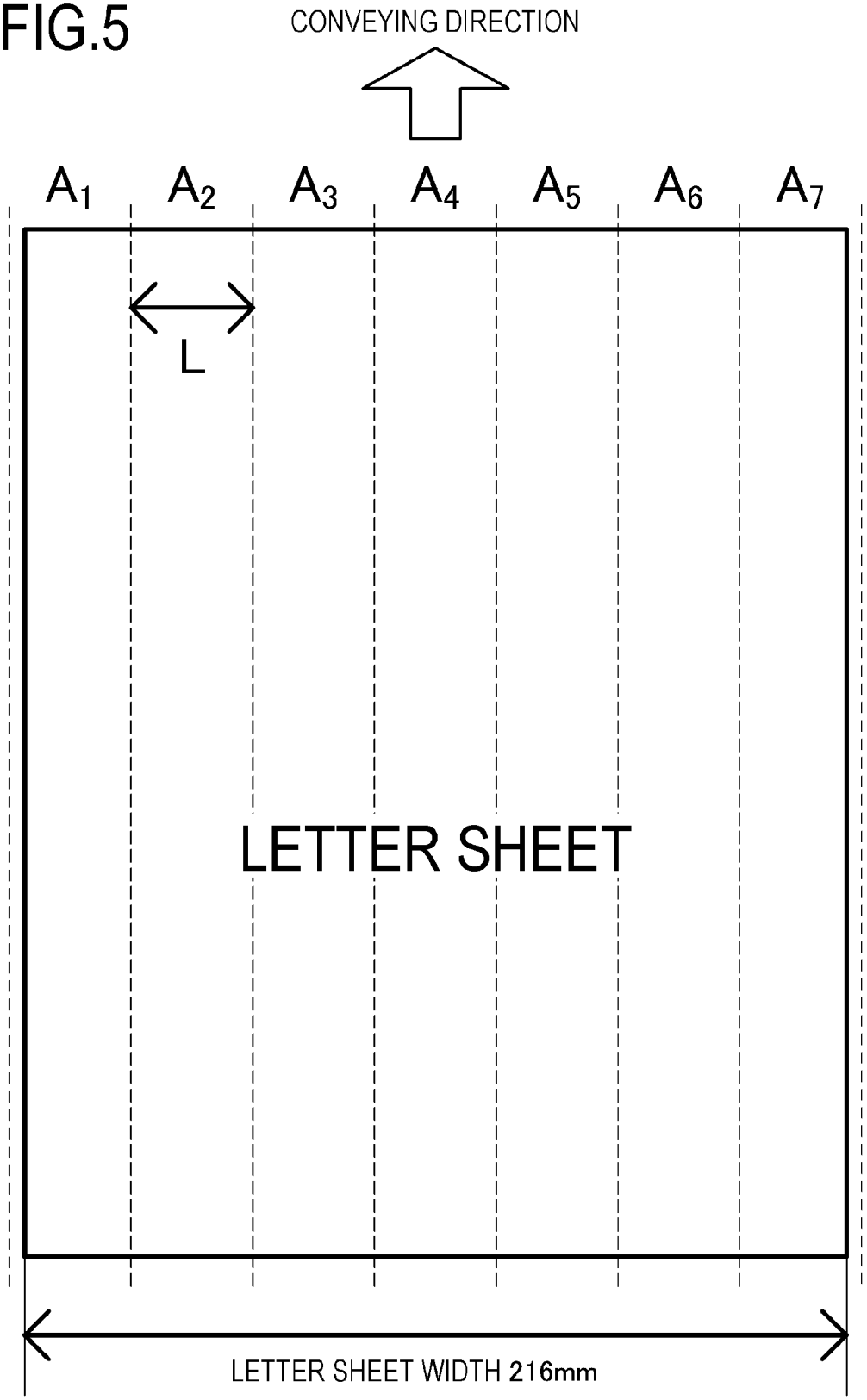
FIG. 5 shows a heating region divided on a longitudinal direction of a recording material P with respect to the recording material P.

FIG. 3B shows a plan view of each layer of the heater 300. A plurality of heat generating blocks HB (HB1 to HB7) (corresponding to heat generating elements), including the first electrical conductor 301, the second electrical conductor 303, and the heat generating resistor 302, are provided in the longitudinal direction of the heater 300 at the back surface layer 1 of the heater 300. The heater 300 of the present Example has a total of seven heat generating blocks HB1 to HB7 in the longitudinal direction of the heater 300. In FIGS. 3A to 3C, the region from the left end of the heat generating block HB1 to the right end of the heat generating block HB7 is the heat generating region, and the length of the heat generating region is 220 mm. In the present Example, all of the heat generating blocks HB have the same width in the longitudinal direction. (It is not necessary for all of the blocks to have the same width.) That is, in the present Example, a plurality of heat generating blocks HB1 to HB7 for heating the toner image, which is formed on the recording material P, are provided for respective heating regions $A_1$ to $A_7$ (as shown in FIG. 5). Further, the toner image formed on the recording material P is fixed to the recording material P by heating using the heat generating blocks HB1 to HB7.

The heat generating blocks HB1 to HB7 have heat generating resistors 302*a*-1 to 302*a*-7 and heat generating resistors 302*b*-1 to 302*b*-7 formed symmetrically when viewed from the longitudinal direction of the heater 300. Further, the first electrical conductor 301 is configured of an electrical conductor 301*a* connected to the heat generating resistors 302*a*-1 to 302*a*-7 and an electrical conductor 301*b* connected to the heat generating resistors 302*b*-1 to 302*b*-7. Likewise, the second electrical conductor 303 is divided into seven electrical conductors 303-1 to 303-7 so as to correspond to the seven heat generating blocks HB1 to HB7.

The electrodes E1 to E7, E8-1 and E8-2 are used for connection to electrical contacts C1 to C7, C8-1 and, C8-2, which are used for supplying electrical power from the below-described control circuit 400 for controlling the heater 300. The electrodes E1 to E7 are used to supply electrical power to the heat generating blocks HB1 to HB7 via the conductors 303-1 to 303-7, respectively. The electrodes E8-1 and E8-2 are used for connection to common electrical contacts, which are used to supply power to the seven heat generating blocks HB1 to HB7 via the electrical conductor 301*a* and the electrical conductor 301*b*. In the present Example, the electrode E8-1 and the electrode E8-2 are provided at both ends in the longitudinal direction. A configuration may, however, be used in which, for example, only the electrode E8-1 is provided on one side, or separate electrodes may be provided on the upstream and downstream sides in the conveying direction of the recording material P.

Further, in the back surface layer 2 of the heater 300, the surface protective layer 307 is formed outside of the portions of the electrodes E1 to E7, E8-1 and E8-2. Therefore, it is possible to connect the electrical contacts C1 to C7, C8-1, and C8-2 to the respective electrodes E1 to E7, E8-1, and E8-2 from the back surface layer 2 side of the heater 300. That is, electrical power can be supplied to the electrodes E1 to E7, E8-1, and E8-2 from the back surface layer 2 side of the heater 300. In addition, the power supplied to at least one heat generating block HB from among the heat generating blocks HB1 to HB7 and the power supplied to the other heat generating blocks HB can be controlled independently.

As a result of providing the electrodes E1 to E7, E8-1, and E8-2 on the back surface of the heater 300, it is unnecessary to conduct the wiring by an electrically conductive pattern on the substrate 305, thereby making it possible to reduce the width of the substrate 305 in the lateral direction. Therefore, by reducing the heat capacity of the substrate 305, it is possible to shorten the start-up time required for the temperature of the heater 300 to rise. In addition, the material cost of the substrate 305 can be reduced. The electrodes E1 to E7 are provided in the region in which the heat generating resistor 302 is provided in the longitudinal direction of the substrate 305.

The technique disclosed in Japanese Patent Application Laid-open No. 2014-59508 uses a material having a characteristic (hereafter referred to as poly-crystalline ceramic material thermistor (PTC) characteristic) such that the resistance value of the heat generating resistor 302 increases with the temperature rise of the heat generating resistor 302. Here, in the portion (sheet passing portion) through which the recording material P passes, the temperature of the heat generating resistor 302 is decreased, because heat escapes from the heat generating resistor 302 to the recording material P. In the non-sheet-passing portion, since heat is not transmitted from the heat generating resistor 302 to the recording material P, the temperature of the heat generating resistor 302 in the non-sheet-passing portion is greater than the temperature of the heat generating resistor 302 in the sheet passing portion. As a result, the resistance value of the heat generating resistor 302 in the non-sheet-passing portion becomes greater than the resistance value of the heat generating resistor 302 in the sheet passing portion, and an electrical current is unlikely to flow through the heat generating resistor 302 in the non-sheet-passing portion. In other words, by using a material having a PTC characteristic for the heat generating resistor 302, it is possible to suppress the increase in temperature of the heat generating resistor 302 in the non-sheet-passing portion. In the present Example, a material having a PTC characteristic is used as the heat generating resistor 302, similar to the technique disclosed in Japanese Patent Application Laid-open No. 2014-59508. The material suitable for the heat generating resistor 302 is not, however, limited to one having a PTC characteristic. Thus, it is also possible to use a material having a characteristic (hereafter referred to as an NTC characteristic) such that the resistance value of the heat generating resistor 302 decreases with the increase in temperature of the heat generating resistor 302, or a material having a characteristic such that the resistance value of the heat generating resistor 302 does not change in response to changes in the temperature of the heat generating resistor 302.

In order to detect the temperatures of the heat generating blocks HB1 to HB7 in the heater 300, thermistors T1-1 to T1-4 and thermistors T2-5 to T2-7 are installed on the sliding surface layer 1 on a sliding surface (the surface on the side in contact with the fixing film 202) side of the heater 300. The thermistors T1-1 to T1-4 and the thermistors T2-5 to T2-7 are formed by thinly providing a material having the NTC characteristic on the substrate 305. Here, the thermistors T1-1 to T1-4 and the thermistors T2-5 to T2-7 may be also formed by thinly providing a material having the PTC characteristic, rather than the material having the NTC characteristic, on the substrate 305. Here, the thermistors T1-1 to T1-4 and the thermistors T2-5 to T2-7 are arranged correspondingly to the heat generating blocks HB1 to HB7, respectively. Therefore, by detecting the resistance values of the thermistors T1-1 to T1-4 and the thermistors T2-5 to T2-7, it is possible to detect the temperatures of all of the heat generating blocks HB1 to HB7.

Further, in the present Example, electrical conductors ET1-1 to ET1-4 for detecting the resistance value of the thermistors T1-1 to T1-4 and a common electrical conductor EG1 are provided to allow an electrical current to flow to the four thermistors T1-1 to T1-4. A thermistor block TB1 is formed by the thermistors T1-1 to T1-4. Likewise, electrical conductors ET2-5 to ET2-7 for detecting the resistance value of the thermistors T2-5 to T2-7 and a common electrical conductor EG2 are provided to allow an electrical current to flow to the three thermistors T2-5 to T2-7. A thermistor block TB2 is formed by the thermistors T2-5 to T2-7.

Next, the effect of using the thermistor block TB1 will be described. First, by forming the common electrical conductor EG1 of the thermistor, it is possible to reduce the cost of forming the wiring of the electrically conductive pattern, as compared with the case of connecting conductors to respective thermistors T1-1 to T1-4. Further, since it is unnecessary to perform the wiring by the electrically conductive pattern on the substrate 305, the width of the substrate 305 in the lateral direction can be reduced. Therefore, it is possible to reduce the material cost of the substrate 305 and to reduce the heat capacity of the substrate 305, thereby shortening the start-up time required for the temperature rise of the heater 300. Since the configuration of the thermistor block TB2 is the same as that of the thermistor block TB1, the description of the thermistor block TB2 will be omitted.

Here, an effective method for reducing the width in the lateral direction of the substrate 305 involves combining the configuration of the heat generating blocks HB1 to HB7, described in relation to the back surface layer 1 shown in FIG. 3A, and the configuration of the thermistor blocks TB1 and TB2, described in relation to the sliding surface layer 1 in FIG. 3A. In the present Example, the surface protective layer 308 (glass, in the present Example) is provided on a sliding surface layer 2 on the sliding surface (surface in contact with the fixing film 202) side of the heater 300. The surface protective layer 308 is provided at least in a region that slides with the fixing film 202 except for both end portions of the heater 300. This is done so as to provide electrical contact for the common electrical conductors EG1, EG2 and the electrical conductors ET1-1 to ET1-4 and the electrical conductors ET2-5 to ET2-7 for detecting the resistance values of the thermistors T1-1 to T1-4 and the thermistors T2-5 to T2-7.

Further, as shown in FIG. 3C, holes for connecting the electrodes E1, E2, E3, E4, E5, E6, E7, E8-1, and E8-2, and the electrical contacts C1 to C7, C8-1, and C8-2 are provided in the heater holding member 201 of the heater 300. As described above, the safety element 212 and the electrical contacts C1 to C7, C8-1, and C8-2 are provided between the metal stay 204 and the heater holding member 201. The electrical contacts C1 to C7, C8-1 and C8-2 contacting the electrodes E1 to E7, E8-1 and E8-2 are electrically connected to the respective electrode portions of the heater 300 by means of spring biasing, welding, or the like. Each electrical contact is connected to the below-described control circuit 400 that controls the heater 300 via a cable or an electrically conductive material, such as a thin metal plate, provided between the metal stay 204 and the heater holding member 201. Electrical contacts provided on the conductors ET1-1 to ET1-4, ET2-5 to ET2-7 for detecting the resistance value of the thermistor and the common electrical conductors EG1 and EG2 of the thermistors are also connected to the below-described control circuit 400.

4. Configuration of Control Circuit 400 that Controls the Heater 300

Figure 4:
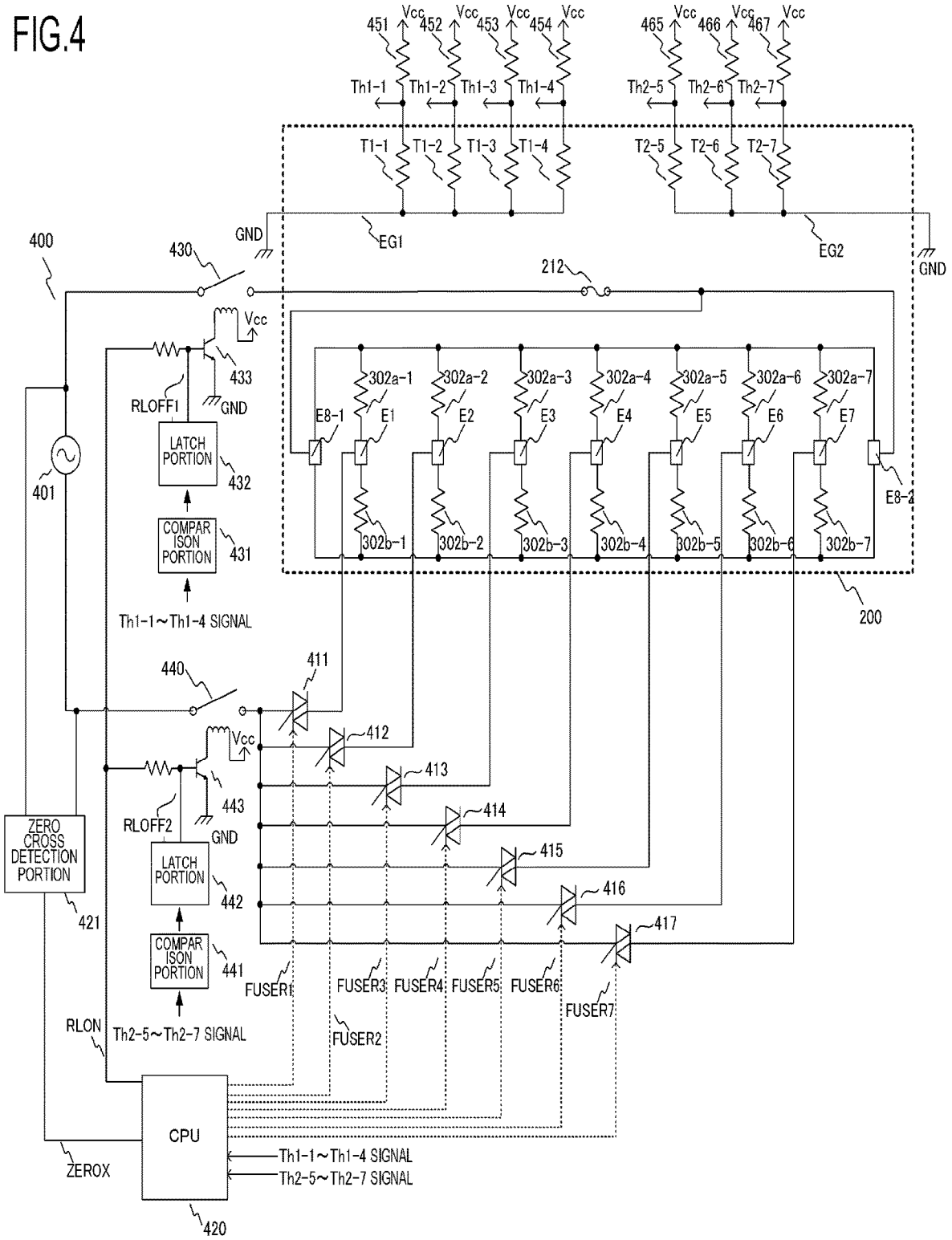
FIG. 4 shows a control circuit for controlling the heater according to Example 1.

FIG. 4 is a circuit diagram of the control circuit 400 for controlling the heater 300 according to Example 1. The AC power supply 401 is a commercial AC power supply connected to the image forming apparatus 100. The electrical power supplied to the heater 300 is controlled by energizing/shutting off a triac 411 to a triac 417. Triacs 411 to 417 are operated in accordance with signals FUSER1 to FUSER7 from a central processing unit (CPU) 420, respectively. Driving circuits of the triacs 411 to 417 are omitted.

In the control circuit 400 for controlling the heater 300, the seven heat generating blocks HB1 to HB7 are independently controlled by the seven triacs 411 to 417. A zero cross detection portion 421 is a circuit for detecting the zero cross of the AC power supply 401 and outputs a ZEROX signal to the CPU 420. The ZEROX signal is used for phase control of the triacs 411 to 417, detection of timing of wavenumber control, and the like.

Next, a method for detecting the temperature of the heater 300 will be described. The temperature detected by the thermistors T1-1 to T1-4 in the thermistor block TB1 is measured by detecting the divided voltages of the thermistors T1-1 to T1-4 and the resistors 451 to 454 as signals Th1-1 to Th1-4 by the CPU 420. Likewise, the temperature detected by the thermistors T2-5 to T2-7 of the thermistor block TB2 is measured by detecting the divided voltages of the thermistors T2-5 to T2-7 and the resistors 465 to 467 as signals Th2-5 to Th2-7 by the CPU 420.

In the internal processing of the CPU 420, the power to be supplied to the heater 300 is calculated, for example, by proportional-integral (PI) control, on the basis of set temperatures of the heat generating blocks HB1 to HB7 and the detected temperatures of the thermistors T1-1 to T1-4 and the thermistors T2-5 to T2-7. Further, the control level of the phase angle (phase control) or the wave number (wave number control) is converted correspondingly to the electrical power supplied to the heater 300, and the triacs 411 to 417 are controlled according to the control conditions.

A relay 430 and a relay 440 are used as a means for shutting off the electrical power supplied to the heater 300 when the heater 300 is excessively heated due to a failure, or the like. The circuit operation of the relay 430 and the relay 440 will be described below. When a relay on (RLON) signal assumes a High state, a transistor 433 is turned ON, and the secondary side coil of the relay 430 is energized from a power supply voltage Vcc, thereby turning ON the primary side contact of the relay 430.

Further, when the RLON signal is in a Low state, the transistor 433 is in an OFF state, and the electrical current flowing from the power supply voltage Vcc to the secondary side coil of the relay 430 is cut off, so that the primary side contact of the relay 430 assumes an OFF state. Likewise, when the RLON signal is in a High state, the transistor 443 is in an ON state and the secondary side coil of the relay 440 is energized from the power supply voltage Vcc, whereby the primary side contact of the relay 440 assumes an ON state. When the RLON signal is in a Low state, the transistor 443 is in an OFF state, and the electrical current flowing from the power supply voltage Vcc to the secondary side coil of the relay 440 is cut off, so that the primary side contact of the relay 440 assumes an OFF state.

Next, the operation of the safety circuit using the relay 430 and the relay 440 will be described. When any one of the detected temperatures that have been detected by the thermistors Th1-1 to Th1-4 exceeds a respectively set predetermined value, a comparison portion 431 operates a latch portion 432, and the latch portion 432 latches a first relay off (RLOFF1) signal to a Low state. When the RLOFF1 signal is in the Low state, the transistor 433 is kept in the OFF state even when the CPU 420 sets the RLON signal to the High state, so that the relay 430 can be kept in the OFF state (safe state). It should be noted that the latch portion 432 outputs the RLOFF1 signal in the open state in the non-latched state.

Likewise, when any one of the detected temperatures that have been detected by the thermistors Th2-5 to Th2-7 exceeds a respectively set predetermined value, a comparison portion 441 operates a latch portion 442, and the latch portion 442 latches a second relay off (RLOFF2) signal to a Low state. When the RLOFF2 signal assumes the Low state, the transistor 443 is kept in the OFF state even when the CPU 420 sets the RLON signal to the High state, so that the relay 440 can be kept in the OFF state (safe state). It should be noted that the latch portion 442 outputs the RLOFF2 signal in the open state in the non-latched state.

5. Method for Controlling the Heater 300 According to Image Information

In the image forming apparatus 100, according to the present Example, power supply to the seven heat generating blocks HB1 to HB7 in the heater 300 is controlled according to image data (image information) sent from an external device (not shown), such as a host computer. Here, FIG. 5 is a view showing seven heating regions $A_1$ to $A_7$ obtained by dividing the recording material P according to this Example in the longitudinal direction of the recording material P. In the present Example, the recording material P is a paper sheet of a LETTER size.

The heating regions $A_1$ to $A_7$ correspond to the heat generating blocks HB1 to HB7, respectively. That is, the heating region $A_1$ is heated by the heat generating block HB1, and the heating region $A_7$ is heated by the heat generating block HB7. The total length of the heating regions $A_1$ to $A_7$ is 220 mm, and the heating regions $A_1$ to $A_7$ are formed by equally dividing the recording material P into seven regions (L=31.4 mm). When the video controller 120 receives the image information from the host computer, it is determined what type of image is formed in each of the heating regions $A_1$ to $A_7$, and the power supply to each heat generating block HB is controlled according to the result of this determination.

More specifically, a toner amount conversion value is acquired by converting the image density of each color obtained from CMYK image data to the toner amount. Then, a scheduled heating temperature for heating the heating regions $A_1$ to $A_7$ is determined according to the toner amount conversion value, so that the recording material P is heated at a greater temperature with respect to an image with a high toner amount conversion value. In the present Example, in order to facilitate the understanding of the heating regions $A_1$ to $A_7$, a portion in which a scheduled image to be formed in the heating region $A_i$ (i=1 to 7) is heated is referred to as an image heating portion $PR_i$ (i=1 to 7). In the recording material P, a portion other than the image heating portion $PR_i$ is set as a non-image-heating portion PP, and the temperature at which the non-image-heating portion PP is heated is set to be less than that of the image heating portion $PR_i$.

First, a method for acquiring the toner amount conversion value D will be described. Image data transmitted from an external device, such as a host computer, are received by the video controller 120 in the image forming apparatus 100 and are converted into bitmap data. In the image forming apparatus 100 according to the present Example, the number of pixels of the image formed on the recording material P is 600 dots per inch (dpi), and the video controller 120 generates bit map data (image density data of each CMYK color) corresponding to this number of pixels.

Figure 6:
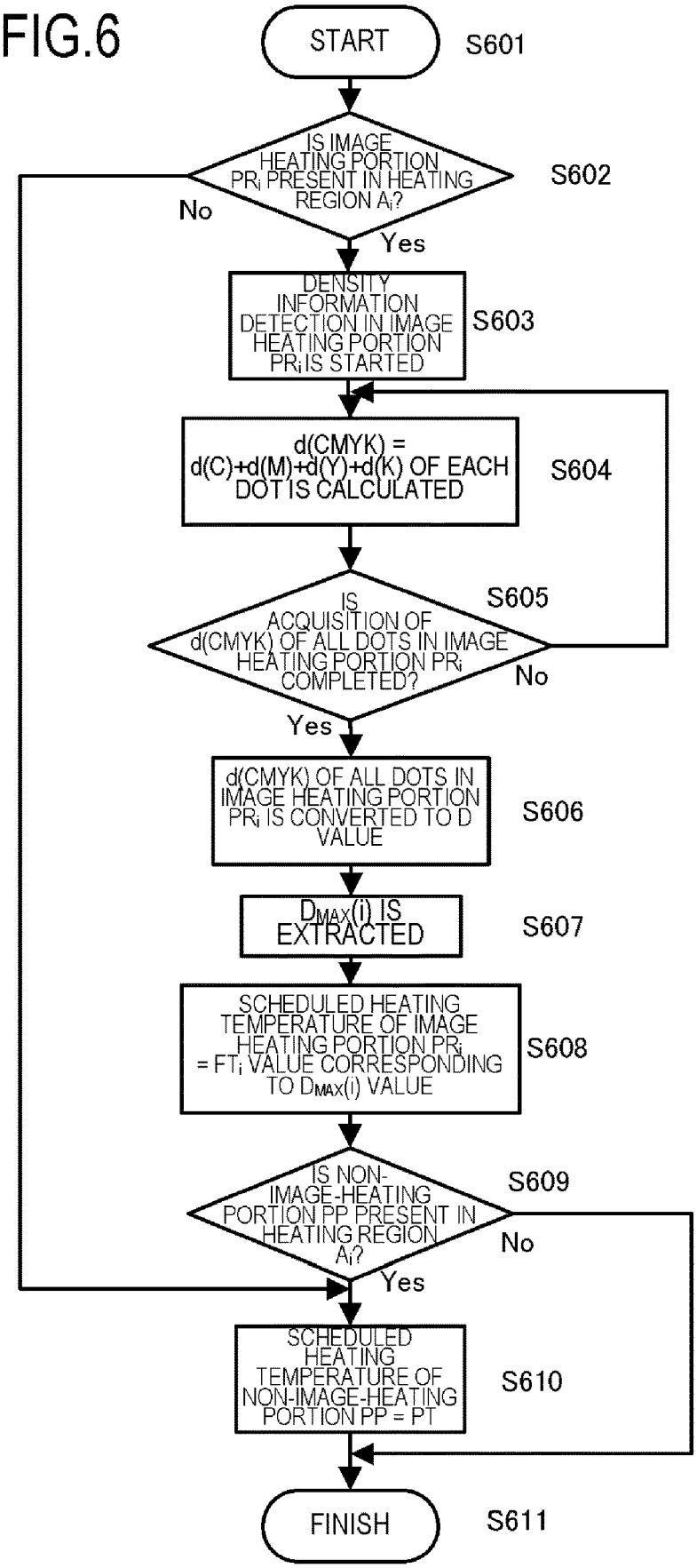
FIG. 6 is a flowchart showing a flow of determining a heating temperature of the heater.

In the image forming apparatus 100 according to the present Example, the image density of each CMYK color for each dot is acquired from the bitmap data, and this image density is converted into the toner amount conversion value D. Here, FIG. 6 is a flowchart showing a flow of determining the heating temperature of the heater 300. Specifically, FIG. 6 is a flowchart showing a flow of acquiring a maximum value $D_{MAX}(i)$ of the toner amount conversion value D in the image heating portion $PR_i$ in each heating region Ai for one recording material P, and determining the heating temperature of the heater 300 corresponding to this maximum value $D_{MAX}(i)$. In the present Example, the target temperature of the heat generating block HB for heating the toner image is set on the basis of the toner amount per unit area of the toner image in the heating region A. Then, the temperature of the heat generating block HB is controlled to the target temperature.

As described above, when the conversion from the image data to the bitmap data is completed, the flow starts from step S601. Whether or not the image heating portion $PR_i$ is present in the heating region Ai is recognized in step S602. When the image heating portion $PR_i$ is absent, the process advances to step S610, the scheduled heating temperature PT for the non-image-heating portion PP is set, and the process is terminated. When there is the image heating portion $PR_i$ in the heating region A, the detection of image density of each dot in the image heating portion $PR_i$ is started in step S603. Image density d(C), d(M), d(Y), and d(K) of each color of C, M, Y, and K for each dot is obtained from the image data converted into CMYK image data. In step S604, the sum value d(CMYK) of the image densities d(C), d(M), d(Y), and d(K) is calculated. The sum value d(CMYK) is calculated for all of the dots in the image heating portion $PR_i$, and, when the sum value d(CMYK) for all of the dots is acquired in step S605, the sum value d(CMYK) is converted into the toner amount conversion value D in step S606.

Here, the image information in the video controller 120 is an 8-bit signal, and the image density d(C), d(M), d(Y), and d(K) per single toner color is expressed by the range from the minimum image density 00h to the maximum image density FFh. The sum value d(CMYK) of the image densities d(C), d(M), d(Y), and d(K) is a 2-byte 8-bit signal. As described above, the sum value d(CMYK) is converted to the toner amount conversion value D (%) in step S606. Specifically, the sum value d(CMYK) is converted to the toner amount conversion value D (%) by taking the minimum image density 00h per single toner color as 0% and the maximum image density FFh as 100%. This toner amount conversion value D (%) corresponds to the actual toner amount per unit area on the recording material P. In the present Example, the toner amount on the recording material P is 0.50 mg/cm$^2$=100%.

Further, in step S607, the toner amount conversion maximum value $D_{MAX}$(i) (%), which is a maximum value, is extracted from the toner amount conversion values D (%) of all dots in the image heating portion $PR_i$. The sum value d(CMYK) is a sum value for a plurality of toner colors, and the value of the toner amount conversion maximum value $D_{MAX}$(i) may exceed 100% in some cases. In the image forming apparatus 100, according to the present Example, when the all-solid image is formed on the recording material P, the toner amount is adjusted to 1.15 mg/cm$^2$ (corresponding to 230% in terms of the toner amount conversion value D) as the upper limit.

When the toner amount conversion maximum value $D_{MAX}$ (i) is obtained in step S607, the scheduled heating temperature $FT_i$ (corresponding to the first target temperature) (described in detail below) corresponding to the toner amount conversion maximum value $D_{MAX}$(i) is set as the scheduled heating temperature for the image heating portion $PR_i$ in step S608. Next, in step S609, it is recognized whether or not the non-image-heating portion PP is present in the heating region A. When the non-image-heating portion PP is not present, the flow is finished in step S611.

When the non-image-heating portion PP is present, the process advances to step S610, and the scheduled heating temperature PT for the non-image-heating portion PP is set, and the process is terminated. The flow described above is performed for the heating regions $A_1$ to $A_7$, and, for each of the heating regions $A_1$ to $A_7$, the scheduled heating temperature $FT_i$ corresponding to each toner amount conversion maximum value $D_{MAX}$(i) is set for the image heating portion $PR_i$. The scheduled heating temperature PT is also set for the non-image-heating portion PP.

Here, FIG. 7 is a diagram showing the relationship between the toner amount conversion maximum value $D_{MAX}$ (i) and the scheduled heating temperature $FT_i$ (i=1 to 7) according to the present Example. In the present Example, the scheduled heating temperature $FT_i$ is variable in five stages according to the toner amount conversion maximum value $D_{MAX}$(i). For images with a large toner amount conversion maximum value $D_{MAX}$(i) and a large amount of toner, the scheduled heating temperature $FT_i$ is set high so that the toner is sufficiently melted. For the non-image-heating portion PP on which no image is formed, the scheduled heating temperature PT (for example, 120° C.) that is less than that of the image heating portion $PR_i$ is set.

Figure 8:
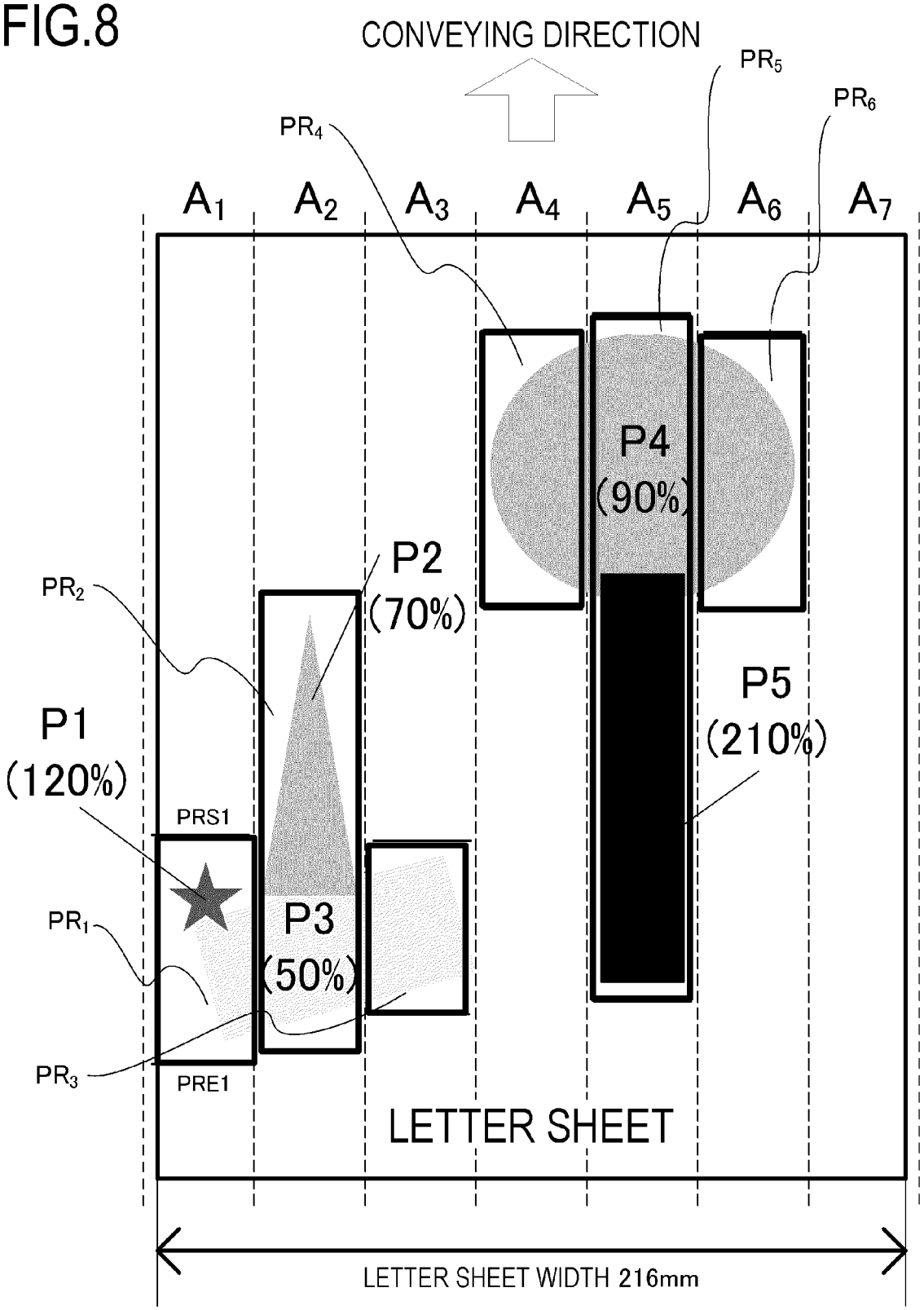
FIG. 8 is a view showing an image formed on a paper sheet of LETTER size.

Hereafter, the images P1 to P5 formed on the recording material P will be described in greater detail with reference to FIG. 8. FIG. 8 is a diagram showing the images P1 to P5 formed on sheets of LETTER size. For ease of explanation, these images P1 to P5 are each using toners of cyan (C), magenta (M), and yellow (Y). The image densities of the images P1 to P5 are uniform, and the values obtained by converting the image densities of the images P1, P2, P3, P4, and P5 into the toner amount conversion value D (%) are 120%, 70%, 50%, 90%, and 210%, respectively.

Here, it is assumed that no image is formed in the heating region $A_7$. The image heating portions $PR_i$ in the heating regions $A_1$ to $A_6$ other than the heating region $A_7$ are referred to as image heating portions $PR_1$ to $PR_6$. Further, the start portion of the image heating portions $PR_1$ to $PR_6$ is taken as PRS, and the end portion of the image heating portions $PR_1$ to $PR_6$ is taken as PRE. That is, in the present Example, in each of the heating regions $A_1$ to $A_7$, the leading end portion of the image formed on one recording material P is taken as PRS and the trailing end portion of the image is taken as PRE. In the present Example, the start portion PRS of the image heating portion $PR_i$ is set upstream by 5 mm from the leading end of the image in the conveying direction of the recording material P. Further, the trailing end portion PRE of the image heating portion $PR_i$ according to the present Example is set downstream by 5 mm from the trailing end of the image in the conveying direction of the recording material P.

Hereafter, the actual temperature at the time of heating the recording material P is referred to as a control temperature TGT. In the present Example, the temperature of the heater 300 is raised from the control temperature TGT (for example, the scheduled heating temperature PT=120° C.) with respect to the non-image-heating portion PP to the control temperature TGT, which is used for heating the image heating portion $PR_i$ until the start portion PRS of the image heating portion $PR_i$, is heated. Further, the temperature rise of the heater 300 is started so that the surface temperature of the fixing film 202 reaches the temperature required for fixing the image on the recording material P.

FIG. 9 is a diagram showing the toner amount conversion maximum value $D_{MAX}$ and the scheduled heating temperature FT in the image heating portion $PR_i$ and the scheduled heating temperature PT in the non-image-heating portion PP. Here, the toner amount conversion maximum value $D_{MAX}$, the scheduled heating temperature FT, and the scheduled heating temperature PT are determined according to the method illustrated by FIGS. 6 and 7. Conventionally, the scheduled heating temperature $FT_i$ for the image heating portion $PR_i$, obtained as described above, has been used as it is as the control temperature TGT when heating the image heating portion $PR_i$ in each of the heating regions $A_1$ to $A_6$. Alternatively, the highest value of the scheduled heating temperature $FT_i$ has been set as the control temperature TGT used in all the image heating portions $PR_i$. In the conventional method, however, as described above, there is a possibility that either the uniformity of the image formed on the recording material P or the power saving property is greatly impaired.

Next, a solution to the problem of the conventional example is described using the configuration according to the present Example with comparison to the conventional example. More specifically, in the case of printing the images shown FIG. 8, the following three configurations are compared. The corrected heating amount in the image heating portion $PR_i$ of each heating region A is taken as the control temperature TGT ($PR_i$), and the corrected heating amount in the non-image-heating portion PP is taken as the control temperature TGT (PP). In all the examples, it is assumed that the control temperature TGT (PP) for all of the non-image-heating portions PP is 120° C. (which is the above-mentioned scheduled heating temperature PT).

In addition, in the image forming apparatus according to the following three examples, it is assumed that, when the temperature at the time of fixing the images having substantially the same color and density, which are formed on the recording material P, is changed by 5° C., a difference of 10% is produced in the glossiness and this difference can be distinguished visually.

In Conventional Example 1-1, a configuration is provided in which the scheduled heating temperature $FT_i$, shown in FIG. 9, is used as the control temperature TGT ($PR_i$) in the image heating portion $PR_i$ of each of the heating regions $A_1$ to $A_7$.

In Conventional Example 1-2, a configuration is provided in which the highest value among the scheduled heating temperatures $FT_i$ shown in FIG. 9, is taken as the maximum scheduled heating temperature $FT_{max}$, and the control temperature TGT ($PR_i$) in the image heating portion $PR_i$ of all the heating regions $A_1$ to $A_7$ is taken as the maximum scheduled heating temperature $FT_{max}$.

In Example 1, a configuration is provided in which the scheduled heating temperature $FT_i$ and the scheduled heating temperature $FT_{i+1}$ for the image heating portion $PR_i$ and the image heating portion $PR_{i+1}$, respectively, which are two adjacent image heating portions, are compared to each other with respect to the scheduled heating temperature $FT_i$ shown in FIG. 9. The scheduled heating temperature FT of the lower value is corrected so as to be closer to the higher scheduled heating temperature FT value, so that the difference between the scheduled heating temperature $FT_i$ and the scheduled heating temperature $FT_{i+1}$ is equal to or less than a specified value, and the control temperature TGT ($PR_i$) to be used for heating the portion $PR_i$ is determined.

A specific method for actually determining the control temperature TGT to be used for heating the recording material P from the scheduled heating temperature FT will be described for the above three examples. In Conventional Example 1-1, as described above, the scheduled heating temperature $FT_i$ for the image heating portion $PR_i$ is used as the control temperature TGT ($PR_i$).

Figure 10:
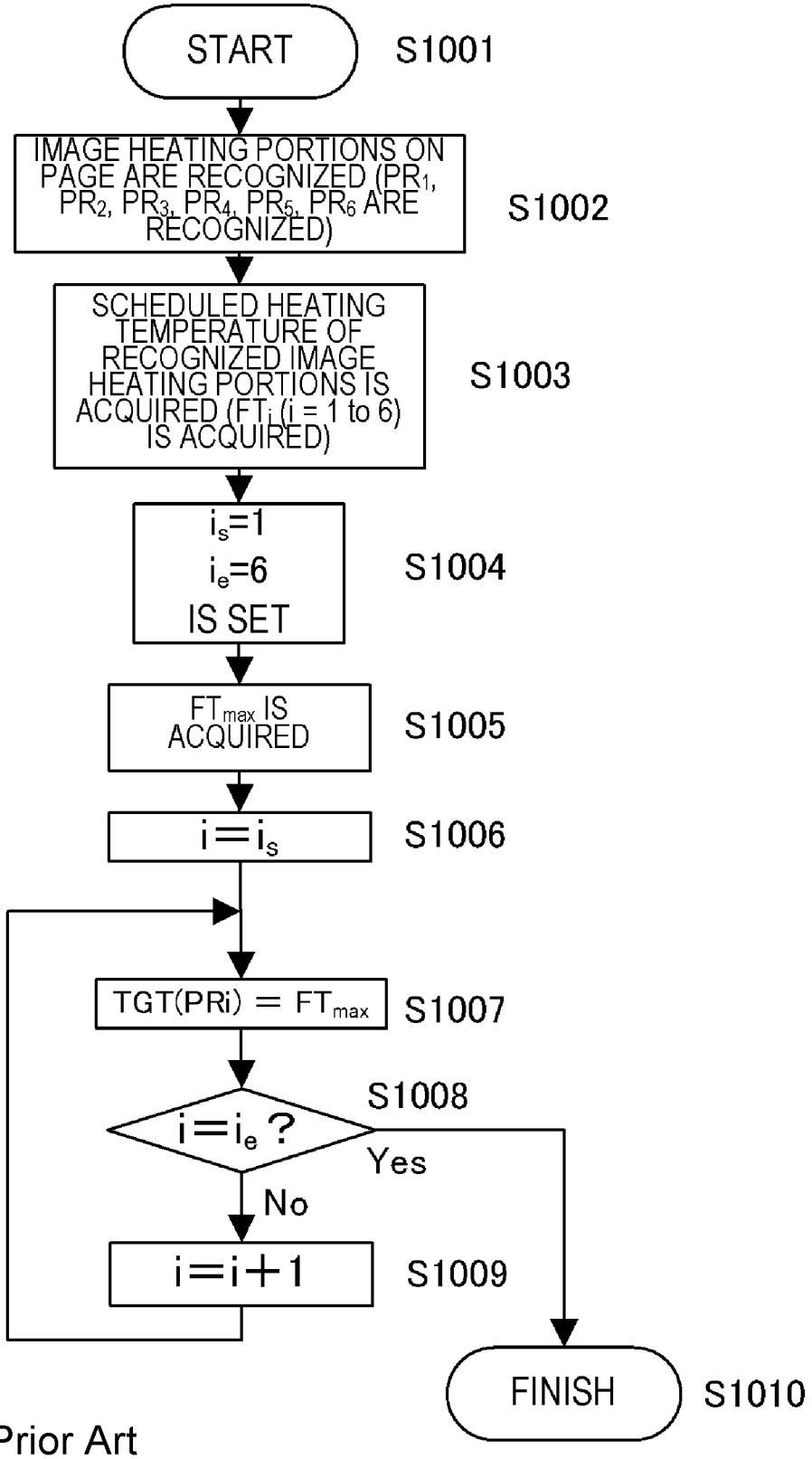
FIG. 10 is a flowchart showing a flow when determining a control temperature for an image heating portion.

Conventional Example 1-2 will be described below using a flowchart. FIG. 10 is a flowchart showing the flow of determining the control temperature TGT (PR) for the image heating portion $PR_i$ in Conventional Example 1-2. When the control flow starts in step S1001, the image heating portion $PR_i$ in one recording material P is recognized in step S1002. When printing the images shown FIG. 8, the image heating portions $PR_1$, $PR_2$, $PR_3$, $PR_4$, $PR_5$, and $PR_6$ are recognized.

Next, in step S1003, the scheduled heating temperatures $FT_i$ (i=1 to 6) for the recognized image heating portions $PR_i$ are acquired. Further, in step S1004, the start number $i_s$ and the finish number $i_c$ of the scheduled heating temperature $FT_i$ are set. In the images shown in FIG. 8, $i_s$=1 and $i_c$=6. In step S1005, the maximum scheduled heating temperature $FT_{max}$, which is the maximum value among the scheduled heating temperatures $FT_i$ (i=1 to 6), is obtained. In step S1006 and subsequent steps, the control temperature TGT (PR) for each image heating portion $PR_i$ is set.

In step S1006, $i=i_s$ (=1) is set, and the control temperature TGT ($PR_i$) to be used when actually heating the heater 300 is sequentially determined from the image heating portion $PR_1$. First, in step S1007, the maximum scheduled heating temperature $FT_{max}$ is set as the control temperature TGT ($PR_1$). Next, in step S1008, it is recognized whether or not the control temperature TGT is the control temperature TGT ($PR_6$) for the last image heating portion $PR_6$ ($i=i_c$). When the control temperature TGT is not the control temperature TGT ($PR_6$), i=i+1 is set in step S1009, and the flow from step S1007 is repeated in order to proceed to the decision operation to control the temperature of the next image heating portion $PR_i$. When it is recognized in step S1008 that the setting up to the control temperature TGT ($PR_6$) for the last image heating portion $PR_6$ ($i=i_c$) is completed, the flow advances to step S1010, and the control flow is finished.

Figure 11:
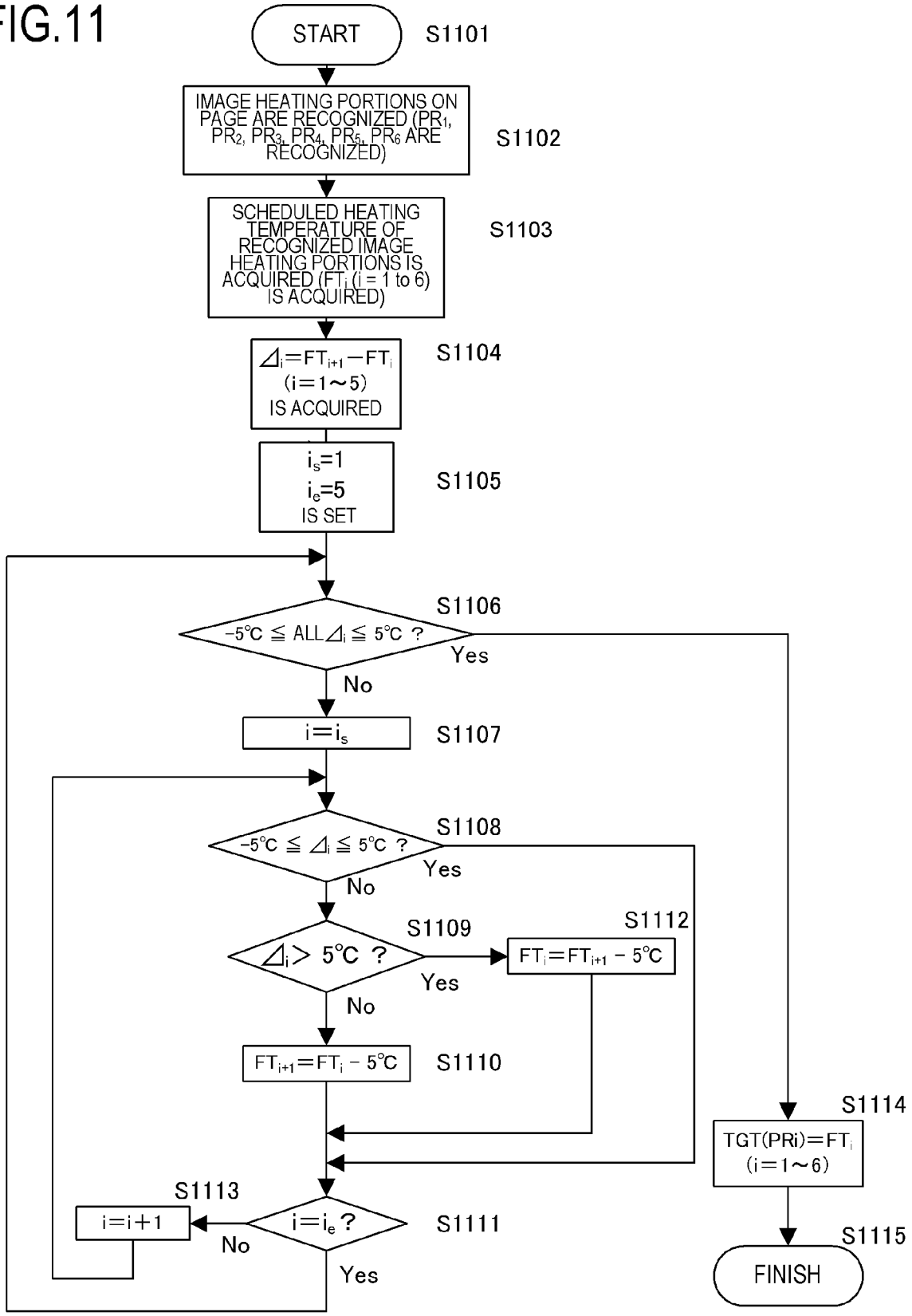
FIG. 11 is a flowchart showing a flow of determining the control temperature for an image heating portion.

Finally, Example 1 will be described with reference to a flowchart. FIG. 11 is a flowchart showing a flow of determining the control temperature TGT ($PR_i$) for the image heating portion $PR_i$ according to Example 1. When the control flow starts in step S1101, the image heating portion $PR_i$ in one recording material P is recognized in step S1102. When the images shown in FIG. 8 are printed, the image heating portions $PR_1$, $PR_2$, $PR_3$, $PR_4$, $PR_5$, and $PR_6$ are recognized.

Next, in step S1103, the scheduled heating temperatures $FT_i$ (i=1 to 6) for the recognized image heating portions $PR_i$ are acquired. In step S1104, for these six scheduled heating temperatures FT, five adjacent difference values Δi (Δ1 to Δ5), which are differences between the scheduled heating temperatures $FT_i$ for the adjacent image heating portions $PR_i$, are acquired. In step S1105, the start number $i_s$ and the finish number $i_c$ of the adjacent difference value $\Delta_i$ are set. In the image shown in FIG. 8, $i_s$=1 and $i_c$=5.

When all of the values of $\Delta_1$ to $\Delta_5$ satisfy the condition −5° C.≤Δ≤5° C. in step S1106, the value of the scheduled heating temperature $FT_i$ for the image heating portion $PR_i$ is used as the control temperature TGT ($PR_i$) in step S1114, and the process is terminated in step S1115. Meanwhile, when the condition −5° C.≤Δ≤5° C. is not satisfied for any one of the five values of $\Delta_1$ to $\Delta_5$ in step S1106, the process advances to step S1107, and the processing of setting all the adjacent difference values $\Delta_i$ between the adjacent heating regions A among the heating regions $A_1$ to $A_7$ to −5° C.≤Δ≤5° C. is started.

In step S1107, $i=i_s$ (=1) is set. Next, in step S1108, when the adjacent difference value $A_i$ at the two currently selected scheduled heating temperatures FT is −5° C.≤Δ≤5° C., the process advances to step S1111. Meanwhile, when the adjacent difference value $A_i$ is not −5° C.≤Δ≤5° C. in step S1108, the process advances to step S1109. Further, when Δ>5° C. in step S1109, the process advances to step S1112, and when the condition Δ>5° C. is not satisfied, the process advances to step S1110.

In step S1110, the relationship of the scheduled heating temperatures FT of the adjacent image heating portions $PR_i$ is set to $FT_{i+1}=FT_i-5°$ C. (the scheduled heating temperature FT after the correction corresponds to the second target temperature). Further, in step S1111, where the adjacent difference value $\Delta_i$ satisfies −5° C.≤Δ≤5° C., it is recognized whether or not the processing up to $\Delta_5$ ($i=i_c$), which is the very last adjacent difference value, has been completed in order to a make a transition to the operation of recognizing the difference between the scheduled heating temperatures FT of the two image heating portions $PR_i$ shifted by one. When the processing up to $\Delta_5$ ($i=i_c$) is completed, the process advances to step S1106, and, when the processing up to $\Delta_5$ ($i=i_c$) is not completed, the process advances to step S1111. In step S1112, the relationship between the scheduled heating temperatures FT of the adjacent image heating portions $PR_i$ is $FT_i=FT_{i+1}-5°$ C. By setting i to i+1 in step S1113, the process makes a transition to the operation of recognizing the difference between the two image heating portions $PR_i$ shifted by one, and the flow from step S1003 is repeated.

Thus, in brief explanation, the difference between the adjacent scheduled heating temperatures FT is sequentially recognized from the adjacent difference value $\Delta_1$ between the scheduled heating temperature $FT_1$ and the scheduled heating temperature $FT_2$. Then, the scheduled heating temperature $FT_i$ is corrected so that the adjacent scheduled heating temperature FT becomes $-5°$ C.$\leq\Delta\leq 5°$ C., whereby the actually used control temperature TGT ($PR_i$) is determined. Then, the flow from step S1108 to step S1111 is executed until the processing of $\Delta_5$ ($i=i_c$), which is the very last adjacent difference value, is completed.

In the present Example, a case when the same toner image is formed over two adjacent heating regions A is described. When the difference between the heating temperatures for two adjacent heating regions A is outside of a predetermined range, the difference between the heating temperatures for the two adjacent heating regions A is corrected so as to be within a predetermined range. More specifically, the heating temperature for one heating region A of the two adjacent heating regions A is corrected to a temperature that is greater than the heating temperature, so that the difference between the heating temperatures for the two adjacent heating regions A is within a predetermined range. Further, the lower heating temperature among the two heating temperatures for the two adjacent heating regions A is corrected.

Here, FIG. 12 is a table in which the control temperatures TGT (PR) according to Conventional Example 1-1, Conventional Example 1-2, and Example 1 are compared. In Conventional Example 1-1, the difference between the control temperature TGT in the image heating portion $PR_4$ and the control temperature TGT in the image heating portion $PR_5$ is 12° C. Further, the difference between the control temperature TGT in the image heating portion PR5 and the control temperature TGT in the image heating portion PR6 is −12° C. That is, in Conventional Example 1-1, the difference between the control temperatures TGT in the adjacent image heating portions $PR_i$ significantly deviates from the range of ±5° C. As a result, a significant difference in glossiness of the image P4 shown in FIG. 8 appears at the boundary between the two image heating portions PR (the boundary between the image heating portion $PR_4$ and the image heating portion $PR_5$ and the boundary between the image heating portion $PR_5$ and the image heating portion $PR_6$).

Next, in Conventional Example 1-2, although there is no portion in which the difference in the control temperature TGT (PR) deviates from the range of ±5° C., as in Conventional Example 1-1, there are many image heating portions $PR_i$ in which the control temperature TGT (PR) is greater than in Conventional Example 1-1. Therefore, the amount of electrical power consumed in the heater 300 is increased, and a power saving property is greatly impaired. Meanwhile, in Example 1, there is no portion in which the difference in the control temperature TGT (PR) deviates from the range of ±5° C. Further, in Example 1, the control temperature in the image heating portions $PR_1$ to $PR_4$ and $PR_6$ is suppressed to be less than that in Conventional Example 1-2, and the deterioration of the power saving property is minimized.

As described above, in the present Example, in the image forming apparatus 100, in which the heating conditions of a plurality of heat generating blocks HB provided in the longitudinal direction of the heater 300 are adjusted according to image information, the uniformity of output image characteristic (gloss of the image, and the like) can be improved. Further, in the present Example, electrical power consumed by the heater 300 can be suppressed. Specifically, as described above, the toner amount conversion value D (%) of each dot in the image heating portion $PR_i$ is calculated and the scheduled heating temperature FT, which is the scheduled heating amount, is determined according to the toner amount conversion maximum value $D_{MAX}(i)$ (%), which is the maximum value of the toner amount conversion value D (%). Further, the difference in the scheduled heating temperatures FT between the adjacent image heating portions $PR_i$ is corrected so as to be not more than the specified amount, and the control temperature TGT ($PR_i$), which is the scheduled heating amount after the correction, is determined.

In the present Example, a method of calculating the toner amount conversion value D (%) according to the image density information of each color toner has been described, but it is also possible to correct the toner amount conversion value D (%) according to the type of the image. In particular, when an image of a horizontal line is formed in the electrophotographic image forming apparatus 100, a phenomenon occurs such that the toner amount per unit area on the recording material P increases as the width of the horizontal line decreases (for example, in the case in which the line width is not more than 20 dots). This phenomenon occurs because, when a linear image, such as that described above, is formed, the toner is intensively developed due to wrap-around of the electrical field at the developing portion (the portion in which the electrostatic latent image on the photosensitive drum 104 is developed). This phenomenon is generally well known.

Considering this phenomenon, for example, the toner amount conversion value D (%) of each dot in the portion of the horizontal line image with a line width of not more than 20 dots can be increased over the toner amount conversion value D (%) of the dots in the case in which the line width is greater than 20 dots. For example, when the line width is 10 dots, the toner amount conversion value D (%) can be increased by a factor of 1.5. Since the actual toner amount on the recording material P can be more accurately predicted by such correction corresponding to the image width information, the scheduled heating temperature $FT_i$ and the control temperature TGT ($PR_i$) can be set to more appropriate values.

Further, the above-described Example illustrates one example of a configuration of the present invention, and it is not always necessary to detect the toner amount conversion value D (%) of all of the dots. For example, as described in Japanese Patent Application Laid-open No. 2013-41118, the region on which an image is formed on the recording material P may be virtually divided into regions of a preset size (for example, 20×20 dots). Image density information of at least one to several points is picked up as a representative value from the image data corresponding to one divided region, and this representative value is converted into the toner amount conversion value D (%). Then, the scheduled heating temperature FT, which is the scheduled heating amount, may be determined based on the toner amount conversion value D (%).

The scheduled heating temperature $FT_i$, which is the scheduled heating amount, may be determined based on the ratio of the dots on which images are formed and the dots on which no image is formed in a region of a preset size (for example, 20×20 dots). In other words, the scheduled heating temperature $FT_i$ may be determined on the basis of the ratio of the area of the image formation portion in which an image is formed and a non-image-formation portion in which no image is formed in a divided region, which is a portion of the heating region A, and is obtained by dividing the heating region A. Further, the scheduled heating amount and the corrected heating amount can be determined, for example, from the power supplied to the heater 300, rather than from the temperature.

Furthermore, the allowable value of the heating amount difference between the adjacent image heating portions $PR_i$ can be changed according to the type of the recording material P and the environment in which the image forming apparatus 100 is used. For example, in the case of using gloss paper, which makes it possible to obtain a higher image gloss, as the recording material P, the allowable value of the heating amount difference between the adjacent image heating portions $PR_i$ is set to be smaller than that when plain paper is used. Accordingly, it is possible to optimize the balance between the uniformity of the image gloss and the power saving property according to the type of the recording material P.

In addition, the execution of the control for correcting the heating temperature, which is described in the present Example, may be limited only to the case in which the prescribed conditions are satisfied. For example, the control can be also executed only when an image having a difference in the toner amount conversion value D (%) within a predetermined range (for example, within ±10%) is formed in the adjacent image heating portions $PR_i$. By doing so, it is possible to further improve the power saving property in the image forming apparatus 100. Alternatively, execution/non-execution of control for correcting the temperature of the heater 300 can be selected according to the type of image. For example, when only a text image is formed on the recording material P, the correction control may not be executed. In a text image, even if there is a difference in gloss in the image, since the difference in gloss is not as noticeable as in the image of a photograph, or the like, it is possible to improve the power saving property without executing the correction control.

As described above, in the present Example, in the case when the same toner image is formed over two adjacent heating regions A and the difference in heating temperature between the two adjacent heating regions A is outside of the predetermined range, the heating temperature for the heating region A is corrected. Specifically, the heating temperature for one heating region A among the two adjacent heating regions A is corrected to be increased, so that the difference between the heating temperatures for the two adjacent heating regions A is within the predetermined range. As a result, the electrical power consumed by the image heating apparatus 200 can be reduced, and the quality of the image formed on the recording material P can be improved.

Example 2

Next, Example 2 will be described. Since the configurations of the image forming apparatus 100, the image heating apparatus 200, the heater 300, and the circuit for controlling the heater 300 according to Example 2 are the same as those of Example 1, the description thereof will be omitted. Further, in Example 1, the control method for heating the heater 300 is different for each heating region A. Therefore, in Example 1, a difference occurs in the degree of warming of the image heating apparatus 200 between the heating regions A (for example, the temperature of the pressure roller 208 is changed for each heating region A) as the printing operation is continued.

For example, when such a difference in the degree of warming occurs between two adjacent heating regions A on which the same image is formed, a difference in image gloss that can easily be visually distinguished may occur even when both heating regions A are heated at the same temperature. In order to solve such a problem, in Example 2, in addition to the features of Example 1, a heating condition in each heating region A is corrected according to the thermal history of each heating region A. In Example 2, the heating temperature for the heating region A is corrected so as to decrease with the increase in a value obtained by subtracting the amount of heat released from the pressure roller 208 from the amount of heat transferred from the heat generating block HB to the pressure roller 208.

In Example 2, the image forming apparatus 100 is provided with a heat accumulation counter as an index representing the degree of warming of each heating region A. The heat accumulation counter for each heating region A counts the heat accumulation amount in each heating region A according to the prescribed method in accordance with the heating operation on the heating region A or the paper passing state of the recording material P. Here, when the count value of the heat accumulation counter is denoted by CT, in Example 2, CT is expressed by the following (Equation 1):

$$CT=(TC\times LC)+(WUC+INC+PC)-(RMC+DC) \quad (1).$$

Here, TC, LC, WUC, INC, PC, RMC, and DC in (Equation 1) will be described with reference to FIGS. 13A to 13C. Note that the heat accumulation count value CT is updated for every page (for each recording material P). As shown in FIG. 13A, TC is a value determined according to the control temperature TGT (PR) at the time of heating the recording material P, and the value of TC increases as the control temperature TGT (PR) becomes higher. As shown in FIG. 13B, LC is determined according to a distance HL (mm) (distance in the conveying direction of the recording material P) over which heating is performed when the image heating portion $PR_i$ is heated, and LC increases as the distance HL increases.

In the heating region A in which an image is formed, values of (TC×LC) for the image heating portion $PR_i$ and the non-image-heating portion PP outside thereof are added up to obtain TC×LC for one page. Further, as shown in FIG. 13C, WUC, INC, and PC are fixed values counted with respect to startup at the start of printing operation, inter-paper interval, and post-rotation at the finish of printing. In addition, as shown in FIG. 13C, RMC and DC, respectively, represent the heat dissipated from the image heating apparatus 200 when the recording material P passes therethrough, and a fixed value counted with respect to heat dissipation to the atmosphere. In FIG. 13C, the value obtained when one LETTER size paper has passed is displayed.

The heat dissipation count DC is counted also when no printing is performed, and when the specified time elapses, the prescribed value is counted (for example, the count is increased by 3 in 1 minute). The heat accumulation count value CT thus determined indicates that the greater is the value, the larger is the heat accumulation amount of the image heating apparatus 200. Therefore, even when the heater 300 is heated at the same control temperature TGT (PR), actually, the greater is the heat accumulation count value CT, the greater becomes the heating amount for heating the paper (recording material P).

FIG. 14 is a diagram showing the relationship between the heat accumulation count value CT and the correction value of the control temperature TGT (PR). The setting of the parameters relating to the heat accumulation count, described above, is determined in advance from the result of recognizing the heat accumulation state and the image characteristics after fixing in the image heating apparatus 200 according to Example 2. A method of correcting the heating temperature of the heater 300 by using the heat accumulation count value CT will be described below. In Example 2, the control temperature TGT ($PR_i$), determined by the same control method as in Example 1, is further corrected with respect to the image heating portion $PR_i$ according to the heat accumulation count value CT with reference to the heat accumulation count value CT up to the immediately preceding page for each heating region A. No correction by the heat accumulation count value CT is performed with respect to the non-image-heating portion PP (the control temperature TGT (PP) is taken as 120° C. regardless of the value of the heat accumulation count value CT).

Here, two adjacent heating regions A having different image patterns will be considered by way of example. Two heating regions $A_i$ and $A_{i+1}$ are supposed to be on LETTER size paper. In the heating region A, the tertiary colors of cyan (C), magenta (M), and yellow (Y) having a toner amount conversion value D (%) of 210% are uniformly formed, except for 5 mm margins at the leading and trailing ends of the sheet (toner amount conversion maximum value $D_{MAX}$(i) (%)=210%) (referred to as image pattern J1).

Figure 15:
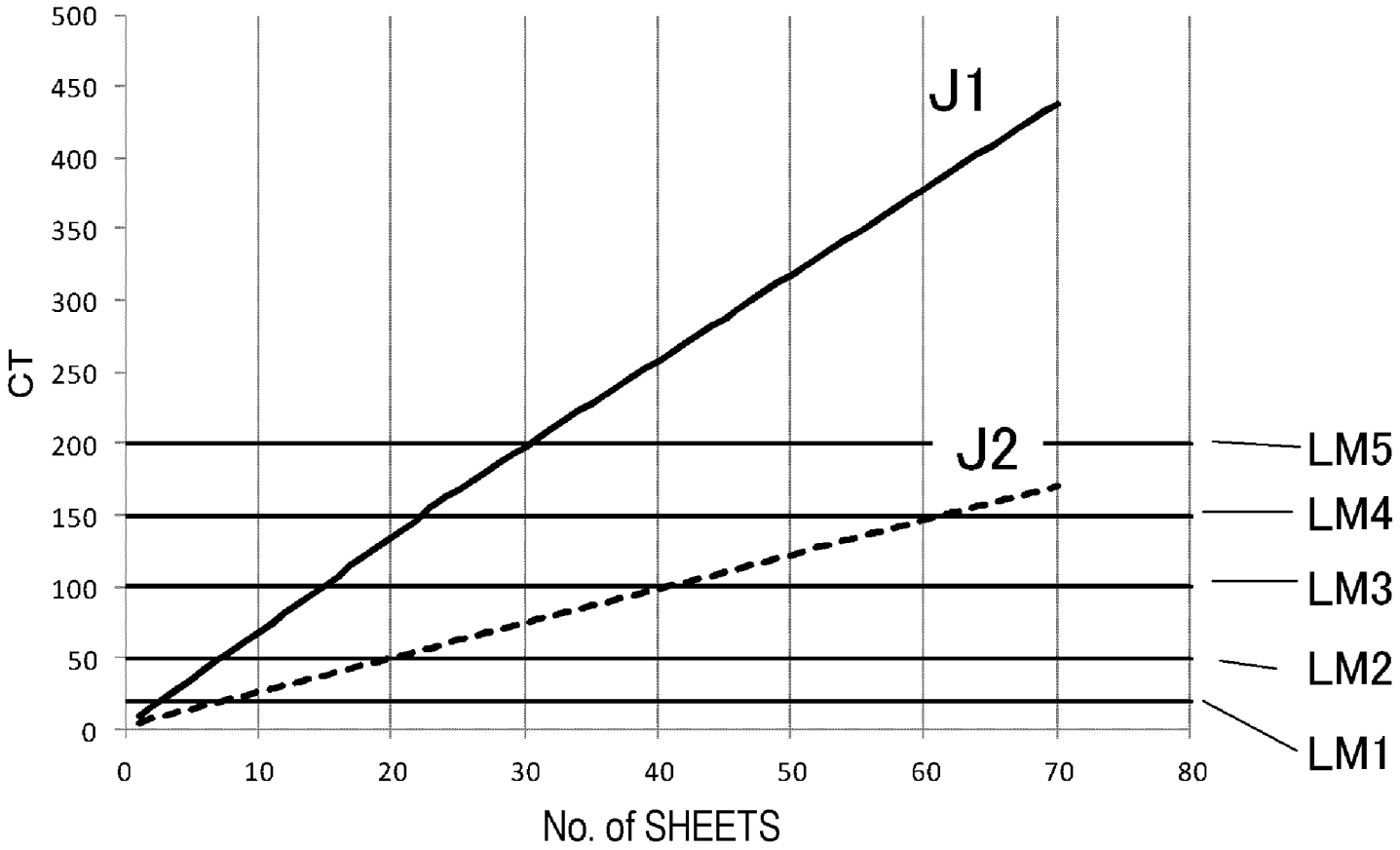
FIG. 15 is a diagram showing a transition of a heat accumulation count value when image patterns are continuously printed.

It is further assumed that no image is formed in the heating region $A_{i+1}$ (referred to as image pattern J2). In order to simplify the explanation, it is also assumed that no image is formed in a region other than the heating region Ai and the heating region $A_{i+1}$. FIG. 15 is a diagram showing the transition of the heat accumulation count value CT when the image patterns J1 and J2 are continuously printed. In FIG. 15, LM1 to LM5 indicate delimiters of correction values for the relationship between the heat accumulation count value CT shown in FIG. 14 and the correction value for the control temperature TGT (PR).

Here, an assumption is made that images of tertiary colors of cyan (C), magenta (M), and yellow (Y) with the toner amount conversion value D (%) of 150% are uniformly printed on the recording material P immediately after 30 sheets of LETTER size paper have been printed in the abovementioned image patterns. It is further assumed that the image is printed on the entire area excluding the 5 mm margins at the leading and trailing ends of the sheet in the heating region $A_i$ and the heating region $A_{i+1}$, and the toner amount conversion maximum value $D_{MAX}$(i) (%)=150% in the image. According to Example 1, the image in the heating region Ai and the heating region $A_{i+1}$ at this time is heated at the control temperature of 199° C.

Meanwhile, in Example 2, the heater 300 is actually heated after the correction has been implemented by taking into account the heat accumulation due to the immediately preceding printing of 30 sheets of the recording material P. More specifically, the heat accumulation count value CT at the time when the printing of 30 sheets is completed is 198.2 in the heating region $A_i$ and 74.5 in the heating region $A_{i+1}$. Then, the control temperature TGT (PR) is corrected from the heat accumulation count value CT in accordance with the relationship shown in FIG. 14. Therefore, as shown in FIG. 14, the control temperature TGT (PR) of the heating region A is corrected to be lower by 6° C., and the control temperature TGT ($PR_{i+1}$) of the heating region $A_{i+1}$ is corrected to be lower by 2° C. In other words, the control temperature TGT ($PR_i$) of the heating region A and the control temperature TGT ($PR_{i+1}$) of the heating region $A_{i+1}$ become 193° C. and 197° C., respectively, and the heater 300 is heated at these temperatures.

Therefore, in Example 2, the image heating portion $PR_i$ in the heating region A and the image heating portion $PR_{i+1}$ in the heating region $A_{i+1}$ are heated at different temperatures in accordance with the heat accumulation count value CT while the toner amount conversion maximum value $D_{MAX}$(i) (%) is 150%. This is a result of correction taking into account the heat accumulation count value CT. Actually, the heating amount by which the recording material P is heated in the image heating portion PR is substantially equal in the heating region $A_i$ and the heating region $A_{i+1}$. Therefore, in Example 2, it is possible to further improve the image uniformity as compared with Example 1.

As described above, in the present Example, the image heating apparatus includes the heater 300 having a plurality of heat generating blocks HB for heating the recording material P on which a toner image is formed, and the pressure roller 208 for pressing the recording material P toward the heater 300. Further, the toner image on the recording material P is heated at the nip portion between the heater 300 and the pressure roller 208. The heating temperature of the heat generating block HB is corrected so as to decrease with the increase in a value obtained by subtracting the amount of heat released from the pressure roller 208 from the amount of heat transferred from the heat generating block HB to pressure roller 208. In other words, in the present Example, by correcting the control temperature of the heat generating blocks HB according to the heat accumulation state of each heating region A, a large difference in the heating amount when heating the recording material P is prevented from occurring between the image heating portions. As a result, it is possible to obtain an output image characteristic that is more uniform than that of Example 1, while maintaining the power saving property of the image forming apparatus 100. In the description above, the heat accumulation counter, serving as an index representing the degree of warming of each heating region $A_i$, is provided in the image forming apparatus 100, and the control temperature of the heat generating blocks HB is corrected according to the value of the heat accumulation counter. It is also possible, however, to measure, for example, the temperature of each heating region Ai in the image heating apparatus and to correct the control temperature of the heat generating blocks HB according to the measured temperatures. Further, for example, temperature detecting means for detecting the temperature of the surface of the pressure roller 208 in each heating region A may be provided individually, and the control temperature for the image heating portion of the corresponding heating region Ai may be corrected according to the respective detected temperature.

Example 3

Next, Example 3 will be described. Since the configurations of the image forming apparatus 100, the image heating apparatus 200, the heater 300, and the circuit for controlling the heater 300 in Example 3 are the same as those of Example 1 and Example 2, the description thereof will be omitted. In the present Example, a plurality of heating regions A are provided in the lateral direction of the recording material P (the direction orthogonal to the conveying direction of the recording material P), and the image heating portion PR in each heating region A is heated according to the image information. In the image pattern handled in Example 1 and Example 2, a plurality of images are gathered together in the conveying direction of the recording material P (the images P1 and P3, P2 and P3, and P4 and P5 in FIG. 8), and there is one image heating portion PR in each heating region A. Meanwhile, as described with respect to Example 3, a method is provided for heating an image pattern in which a plurality of images are not gathered in the conveying direction of the recording material P.

In the present Example, when the interval between a plurality of toner images formed in each heating region A is greater than a predetermined interval, a control temperature at the time of heating the plurality of toner images and the non-image-formation regions between the plurality of toner images in each heating region A is individually set based on the image information. Meanwhile, when the interval between the plurality of toner images formed in each heating region A is not more than the predetermined interval, a control temperature at the time of heating the non-image-formation regions and the plurality of toner images in each heating region A is set to the common control temperature based on the image information.

Figure 16:
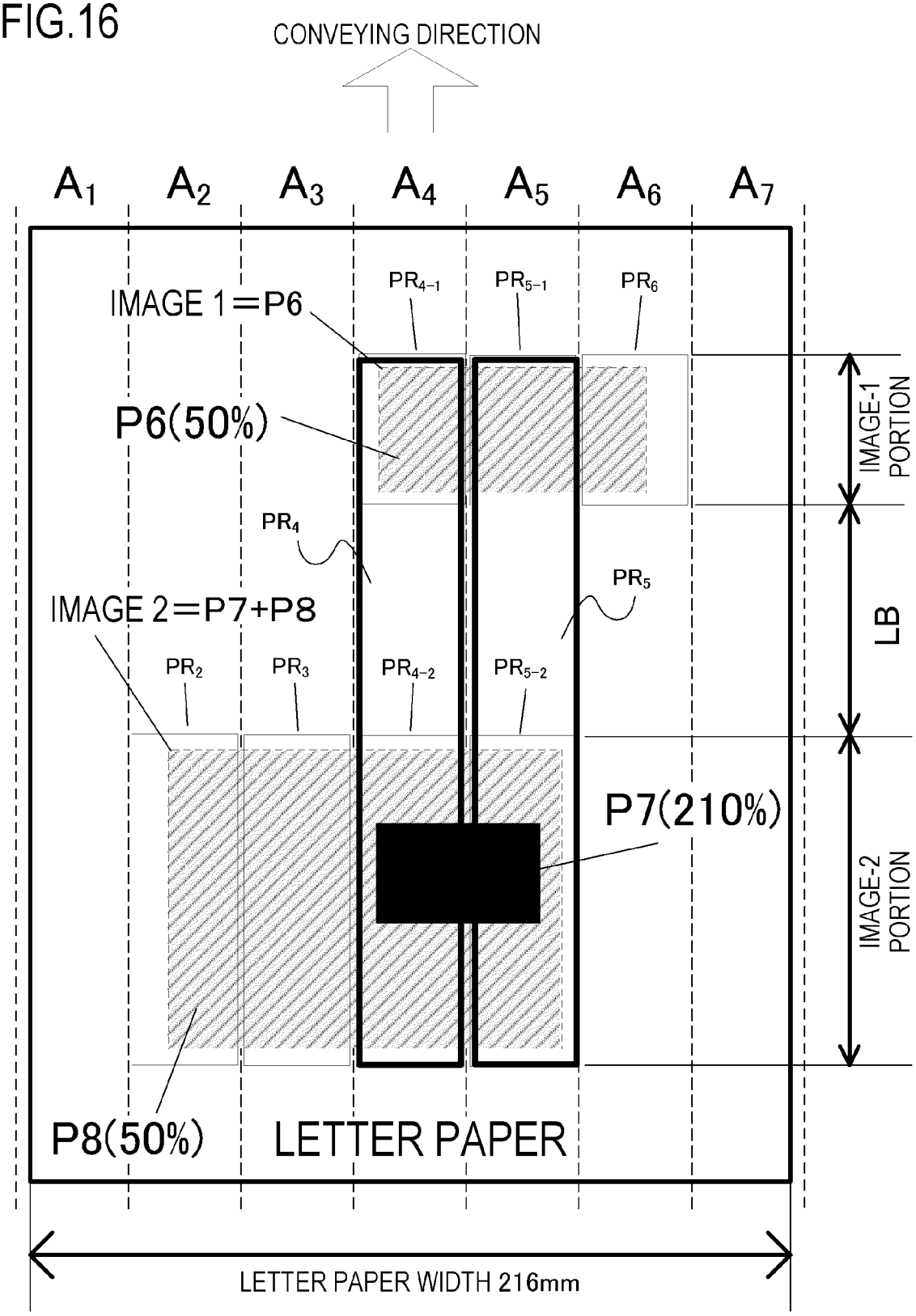
FIG. 16 is a view showing a recording material, on which a plurality of images are formed, in one heating region.
Figure 18:
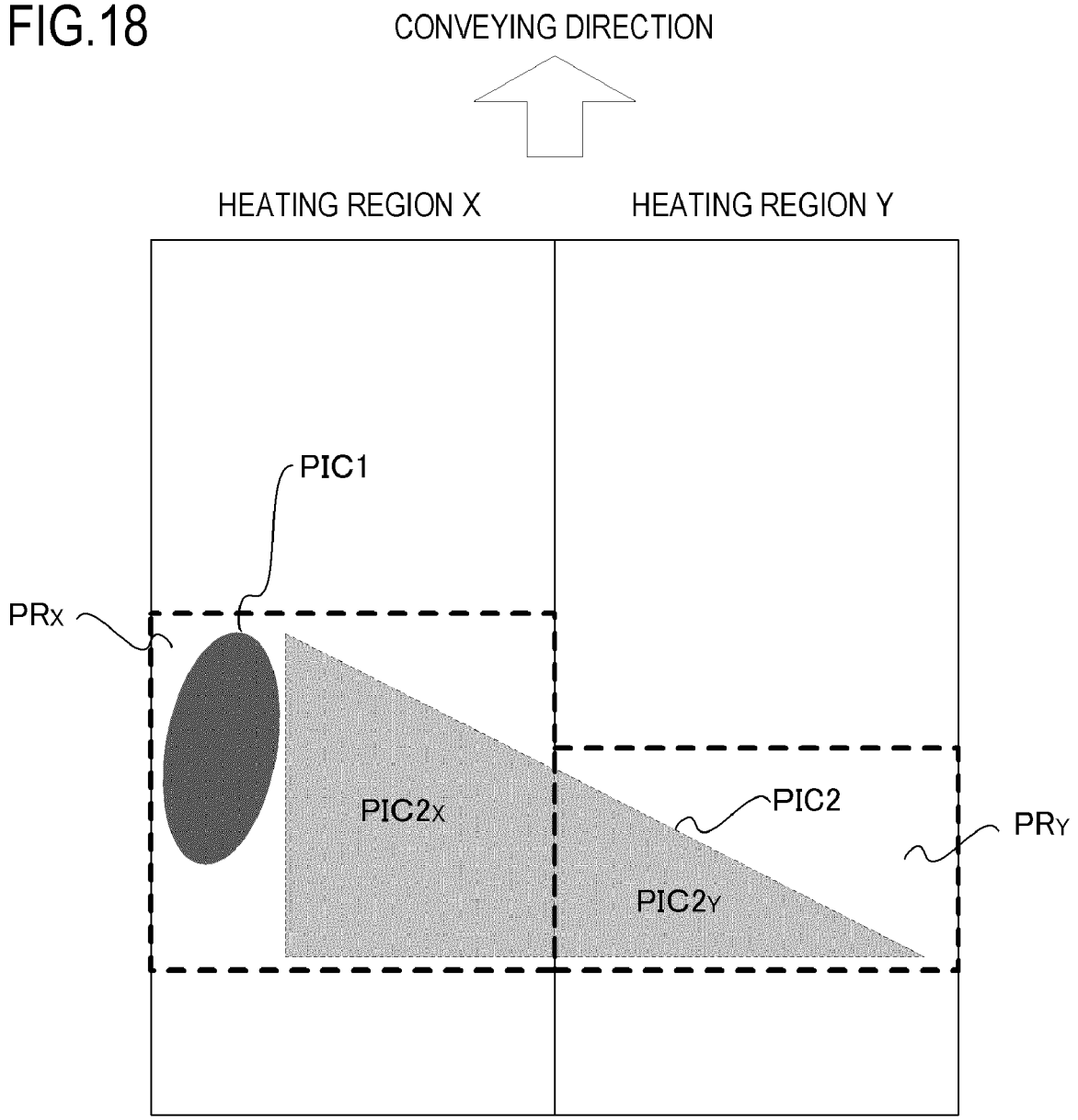
FIG. 18 is an enlarged view of two heating regions divided in a direction orthogonal to the conveying direction of the recording material.

The explanation below uses the image pattern shown in FIG. 16. FIG. 16 shows a recording material P on which a plurality of images are formed in one heating region A in the conveying direction of the recording material P. More specifically, FIG. 16 shows a pattern composed of P6, P7, and P8, in which an image is formed in two places in the conveying direction of the recording material P (P6 is defined as image 1, and an image composed of P7 and P8 is referred to as image 2). Focusing on the heating region A4 and the heating region A5, image 1 and image 2 are arranged apart from each other in the conveying direction of the recording material P. Conventionally, image 1 and image 2 have been separately heated at a temperature corresponding to the respective image information regardless of the distance between the images (the region between image 1 and image 2 has been handled as the non-image-heating portion PP described in Examples 1 and 2). When the distance between image 1 and image 2 is sufficiently large, a high power saving effect can be obtained with the conventional method.

When the distance between image 1 and image 2 is short (for example, the distance is 20 mm), however, the electrical power required to raise the heating temperature, which has temporarily decreased in the non-image-heating portion PP, to the temperature at which image 2 is heated, can surpass the electrical power that can be saved by lowering the temperature for the non-image-heating portion PP. More specifically, the electrical power that can be saved by setting the heating temperature of the heater 300 with respect to the non-image-heating portion PP between image 1 and image 2 can be surpassed by the electrical power required to raise the temperature, which has temporarily decreased in the non-image-heating portion PP, to the temperature at which image 2 is heated. In order to resolve such a problem, in Example 3, when two images separated from each other in the conveying direction of the recording material P are heated, whether or not to handle the plurality of image heating portions PR separately can be switched according to the distance between the images in the conveying direction of the recording material P. That is, it is possible to handle the plurality of image heating portions PR as one image heating portion PR.

In FIG. 16, the image heating portions $PR_2$ to $PR_6$ show the image heating portions PR corresponding to the heating regions $A_2$ to $A_6$, respectively. The image heating portions $PR_{4-1}$, $PR_{4-2}$ and $PR_{5-1}$, $PR_{5-2}$ show the image heating portions PR in the case in which separate image heating portions PR are set for image 1 and image 2. Meanwhile, the image heating portions PR4 and PR5 show the image heating portions PR in the case in which one image heating portion PR is provided for image 1 and image 2. The distance LB between the image heating portions is the distance between image 1 and image 2.

As described above, when the distance LB between the image heating portions is long, the image heating portions PR in the heating regions $A_4$ and $A_5$ may be separated into the image heating portions $PR_{4-1}$, $PR_{4-2}$ and $PR_{5-4}$, $PR_{5-2}$ in the conventional manner. When the distance LB between the image heating portions is less than the prescribed distance, however, the image heating portions in the heating regions $A_4$ and $A_5$ may be taken as the image heating portions $PR_4$ and $PR_5$. In the present Example, from the viewpoint of the above-described power saving property, when the distance LB between the image heating portions is less than 100 mm, image 1 and image 2 are included in one image heating portion PR.

Therefore, when the distance LB between the image heating portions is less than 100 mm, the control temperature TGT (PR) for each image heating portion $PR_i$ is determined similarly to Example 1, with image 1 and image 2 being taken as a batch image. Meanwhile, when the distance LB between the image heating portions is at least 100 mm, the same control as in Example 1 is performed for image 1 and image 2, and the control temperature TGT (PR) for each image heating portion $PR_i$ is determined.

FIGS. 17A and 17B are diagrams showing the values of the control temperature TGT in the heating regions $A_2$ to $A_6$ in the case of printing the image shown in FIG. 16 in Example 3. More specifically, FIG. 17A is a diagram showing the control temperature TGT in the case in which the distance LB between image heating portions is 50 mm. Further, FIG. 17B is a diagram showing the control temperature TGT in the case in which the distance LB between the image heating portions is 120 mm. Comparing FIG. 17A with FIG. 17B, since the setting of the image heating portion PR is different in the heating region $A_4$ and the heating region $A_5$, there is a difference in the control temperature TGT between the heating region $A_4$ and the heating region $A_5$. More specifically, with respect to the heating regions $A_4$, $A_5$, and $A_6$, the control temperatures TGT for heating the image-1 portion are different. Further, with respect to the heating regions $A_4$ and $A_5$, the control temperatures TGT for the distance LB between the image heating portions are also different.

When the distance LB between the image heating portions is 50 mm (FIG. 17A), the toner amount conversion maximum value $D_{MAX}(i)$ (%) in the image heating portions PR4 and PR5 becomes the toner amount conversion value D (%) (210%) of $P_7$ in image 2. Therefore, when the distance LB between the image heating portions is 50 mm (FIG. 17A), the control temperatures TGT ($PR_4$) and TGT ($PR_5$) are 205° C., including the image 1 portion and the portion corresponding to the distance LB between the image heating portions, which are included in the image heating portions $PR_4$ and $PR_5$. Further, the control temperatures TGT ($PR_3$) and TGT ($PR_6$) in the adjacent heating region $A_3$ and heating region $A_6$ are 200° C.

Meanwhile, when the distance LB between the image heating portions is 120 mm (FIG. 17B), the control temperature TGT is determined separately for image 1, the LB portion, and image 2. Therefore, when the distance LB between the image heating portions is 120 mm (FIG. 17B), the control temperature TGT is suppressed to a lower temperature as compared with the case in which the distance LB between the image heating portions is 50 mm (FIG. 17A). Comparing FIG. 17A with FIG. 17B, it can be determined that a higher power saving property is obtained with the setting value of the control temperature TGT used in FIG. 17B.

As described above, however, this is limited to the case when the distance LB between the image heating portions is long (at least 100 mm in Example 3). When the distance LB between the image heating portions is short (less than 100 mm), the mode represented in FIG. 17A in which the control temperature TGT is constant and image 1 and image 2 are heated in a continuous manner ensures a higher power saving property than the mode represented in FIG. 17B in which the heating is performed while changing the control temperature TGT for each location.

As described above, in Example 3, the heating region A is the heating region $A_i$ formed by dividing the surface of the recording material P in the direction orthogonal to the direction in which the recording material P is conveyed, and the plurality of heat generating blocks HB are arranged side by side in the direction orthogonal to the direction in which the recording material P is conveyed. Further, when the interval between the plurality of toner images formed in the heating region Ai is greater than the predetermined interval, in the heating region Ai, the regions between the plurality of toner images and the plurality of toner images are heated by the heat generating blocks HB. When the interval between the plurality of toner images formed in the heating region Ai is not more than the predetermined interval, in the heating region Ai, the regions between the plurality of toner images are not heated by the heat generating blocks HB. Meanwhile, the plurality of toner images are heated by the heat generating blocks HB. In other words, in the present Example, when heating two images arranged apart from each other in the conveying direction of the recording material P, switching is performed between a mode in which the image heating portions PR are handled separately and a mode in which they are handled as a single image heating portion PR according to the interval between the images in the conveying direction of the recording material P. This makes it possible to obtain a higher power saving effect in the image forming apparatus as compared with the related art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

We claim:

1. A fixing apparatus comprising:

(A) a cylindrical film;

(B) a roller configured to form a nip portion for nipping and conveying a recording medium in cooperation with the film;

(C) a heater provided in an inner space of the film, the heater having:

(a) a first heat generating element configured to heat a first heating region at the nip portion; and (b) a second heat generating element located next to the first heat generating element in a direction orthogonal to a conveying direction of the recording medium, and configured to heat a second heating region that is located next to the first heating region in the direction orthogonal to the conveying direction of the recording medium at the nip portion; and (D) a control portion that controls electrical power to be supplied to the first and second heat generating elements, the control portion being capable of individually controlling the first and second heat generating elements such that each of the first and second heat generating elements is maintained at a target temperature, and the control portion sets the target temperatures of the first and second heat generating elements according to an image density of a toner image, wherein, in a case that (i) a first toner image formed on the recording medium passes through both of the first heating region and the second heating region, (ii) the first toner image includes an image portion having a first portion passing through the first heating region and a second portion passing through the second heating region, (iii) the difference in an image density between the first portion and the second portion is within a predetermined image density range, (iv) a second toner image formed on the recording medium on which the first toner image is formed passes through the first heating region, and (v) an image density of the second toner image is higher than that of the first toner image, then the control portion sets the target temperature for the second heat generating element to a temperature higher than the target temperature corresponding to the second portion of the first toner image.

2. The fixing apparatus according to claim 1, wherein the image density is acquired based on image information on an image formed on the recording medium.

3. The fixing apparatus according to claim 2, wherein the image information is a density of the image formed on the recording medium.

4. The fixing apparatus according to claim 2, wherein the image information includes an information according to a width of an image formed in the first and second heating regions.

* * * * *